US010208539B2

(12) United States Patent
Beard

(10) Patent No.: US 10,208,539 B2
(45) Date of Patent: Feb. 19, 2019

(54) EXTENDABLE ACCESS DEVICE

(71) Applicant: Michael Beard, Warwickshire (GB)

(72) Inventor: Michael Beard, Warwickshire (GB)

( * ) Notice: Subject to any disclaimer, the term of this patent is extended or adjusted under 35 U.S.C. 154(b) by 76 days.

(21) Appl. No.: 15/527,914

(22) PCT Filed: Nov. 18, 2015

(86) PCT No.: PCT/GB2015/053515
§ 371 (c)(1),
(2) Date: May 18, 2017

(87) PCT Pub. No.: WO2016/079516
PCT Pub. Date: May 26, 2016

(65) Prior Publication Data

US 2018/0320444 A1 Nov. 8, 2018

(30) Foreign Application Priority Data

Nov. 18, 2014 (GB) ..... 1420406.9
Nov. 21, 2014 (GB) ..... 1420694.0
Nov. 21, 2014 (GB) ..... 1420697.3

(51) Int. Cl.
*E06C 9/08* (2006.01)
*E06C 1/12* (2006.01)
*E04F 11/06* (2006.01)

(52) U.S. Cl.
CPC ..... *E06C 9/08* (2013.01); *E04F 11/068* (2013.01); *E06C 1/125* (2013.01)

(58) Field of Classification Search
CPC ... E06C 9/08; E06C 9/085; E06C 7/06; E06C 1/125; E04F 11/04; E04F 11/064; E04F 11/066; E04F 11/068; B63B 27/146
(Continued)

(56) References Cited

U.S. PATENT DOCUMENTS 1,178,314 A * 4/1916 Greco ..... E06C 9/08
182/85
1,380,518 A * 6/1921 Bellig ..... F16B 12/46
135/909

(Continued)

FOREIGN PATENT DOCUMENTS

CN 200971751 Y 11/2007

OTHER PUBLICATIONS

Mar. 24, 2016 International Search Report for PCT/GB2015/053515.
Mar. 24, 2016 Written Opinion of International Searching Authority for PCT/GB2015/053515.

*Primary Examiner* — Katherine W Mitchell
*Assistant Examiner* — Shiref M Mekhaeil
(74) *Attorney, Agent, or Firm* — Hahn Loeser & Parks LLP

(57) ABSTRACT

The present invention relates to a particularly compact and safe extendable access device for gaining access to elevated locations via a hatch opening. The access device comprises a telescopic ladder with a plurality of sliding elements movable between an extended position and a retracted position, each sliding element comprising two stiles connected by a rung. The stiles of each sliding element are interlocked with the stiles of adjacent sliding elements, wherein each sliding element comprises a first locking mechanism for releasably connecting at least one of the stiles to an adjacent stile of an adjacent sliding element, the first locking mechanism being adapted to lock each sliding element in its retracted position. The first locking mechanism of each sliding element is adapted to releasably connect at least one stile of each sliding element to a stile of an adjacent sliding element, which is closer to a top end of the telescopic ladder, and is adapted to automatically disconnect said stiles once an adjacent sliding element, which is closer
(Continued)

to a bottom end of the telescopic ladder, is in its extended position. The first locking mechanism is adapted to automatically connect the at least one stile of said sliding element to a stile of the adjacent sliding element, which is closer to a top end of the telescopic ladder, when the adjacent sliding element, which is closer to the bottom end of the telescopic ladder, is moved from its extended position towards its retracted position.

2 Claims, 41 Drawing Sheets

(58) Field of Classification Search
USPC ..... 248/300, 304, 200; 16/267, 286, 287, 16/289; 211/118
See application file for complete search history.

(56) References Cited

U.S. PATENT DOCUMENTS 1,383,025 A * 6/1921 Reynolds ..... A47G 25/0692 211/113
1,842,786 A * 1/1932 Kirsch ..... A47H 1/142 248/225.11
1,898,520 A * 2/1933 Barraclough ..... E04F 11/066 182/158
1,953,038 A * 3/1934 Bessler ..... E04F 11/068 108/33
2,095,392 A * 10/1937 Marschke ..... E04F 11/068 182/217
2,542,398 A * 2/1951 Crumpton ..... E06C 1/125 182/195
2,649,237 A * 8/1953 Bjorklund ..... E04F 11/064 182/163
2,836,336 A * 5/1958 Hansen ..... E06C 9/08 182/113
2,907,401 A * 10/1959 Wagner ..... E06C 1/54 182/78
3,024,863 A * 3/1962 Tapp ..... E04F 11/064 182/78
3,068,958 A * 12/1962 McCann ..... E04F 11/04 182/89
3,789,955 A * 2/1974 Knapp ..... E04F 11/04 182/78
5,595,028 A * 1/1997 Handzlik ..... A47B 46/005 248/300
5,970,905 A * 10/1999 Jaramillo, Sr. ..... B63B 27/146 114/362
6,766,992 B1 * 7/2004 Parker ..... F16M 13/022 248/218.4
7,841,448 B2 * 11/2010 Lair ..... E04F 11/064 182/77
9,695,630 B1 * 7/2017 Arthur ..... E04B 1/76
9,869,084 B2 * 1/2018 Charles ..... E04B 1/36
2005/0028320 A1 * 2/2005 Latimer ..... E04F 11/064 16/231
2005/0029042 A1 * 2/2005 Latimer ..... E04F 11/064 182/77
2007/0256893 A1 * 11/2007 Horn ..... E06C 9/08 182/127
2007/0256894 A1 * 11/2007 Horn ..... E06C 9/08 182/127
2008/0023269 A1 * 1/2008 Parker ..... E06C 1/125 182/195
2008/0060874 A1 * 3/2008 Lair ..... E06C 1/12 182/77
2009/0255757 A1 * 10/2009 Burke ..... E04F 11/064 182/78
2010/0089695 A1 * 4/2010 McIntire ..... E04F 11/064 182/77
2012/0199417 A1 * 8/2012 Richey ..... E04F 11/064 182/129
2013/0118832 A1 * 5/2013 Hedley ..... E06C 5/02 182/106
2013/0256057 A1 * 10/2013 Kasinski ..... E04F 11/064 182/81
2014/0190766 A1 * 7/2014 Parker ..... E06C 9/08 182/93
2014/0196388 A1 * 7/2014 Kasinski ..... E04F 11/062 52/186
2016/0333592 A1 * 11/2016 Alexander ..... E04F 11/064
2017/0350134 A1 * 12/2017 Tompkins ..... E06C 9/10
2018/0128049 A1 * 5/2018 Parker ..... E04F 11/068

* cited by examiner

EXTENDABLE ACCESS DEVICE

The present application is a submission under 35 USC § 371 of international application no. PCT/GB2015/053515, filed 18 Nov. 2015 and published in the English language with publication number WO 2016/079516 A1 on 26 May 2016, which claims the benefit of the filing dates of GB 1420406.9 filed 18 Nov. 2014, GB 1420694.0 filed 21 Nov. 2014, and GB 1420697.3 filed 21 Nov. 2014.

The present invention relates to extendable access devices for gaining access to elevated locations via a hatch opening. In particular, the present inventions relates to access devices for gaining access to a loft. The present invention further relates to a method for providing access to an elevated location such as a loft.

BACKGROUND TO THE INVENTION

There are many types of access devices including ladders used to gain access to lofts, and elevated and remote locations. The majority are bulky, consuming otherwise useful space when fitted and stored in the loft, they are complex and difficult to install and often difficult and often dangerous to use. Some modern ladder types are more compact using telescopic and concertina configurations and these are generally easier to install, easier and safer to use and take up less space. A most effective ladder used for gaining access to a loft or from one place to another is one that can be located wholly within the access aperture or loft door hatch so taking up none or any useful floor or space. Location totally within the access aperture or door hatch also enables good access to the ladder from either side to release, lower and extend the ladder below or above that aperture. A compact nested ladder used for this purpose has many other benefits. The smaller are the elevation and plan profiles and volume of the retracted ladder assembly the more loft access apertures and door hatches it can be fitted to without modification. The smaller, simpler, and lighter is the closed retracted ladder assembly and mounting the easier it is to fit and use.

Other features such as spring biasing, low operational loads, safe lowering and extension of the ladder and safe closing and retracting of the ladder add to the benefits the ladder can offer the user and installer. While some ladders already provide solutions for the installer and user there is still much opportunity for improvement. Further reducing the size, weight and bulk of the closed retracted ladder, making the ladder easier and faster to open and close, and making the ladder easier, quicker and safer to install are features and benefits of this invention, a compact, quick to fit and quick to release, cantilevered mounted, self supporting access device.

There are various types of compact telescopic or multi-section extending ladders that are suited to being adapted for use as a ladder for accessing lofts or attics. Many of the existing designs have substantial supporting frames, structures and mechanisms to allow the ladder to be fixed and supported near to the loft access aperture. Their bulk and complexity make them difficult to install and use, and take up unnecessary space in the access aperture and space above and around the access aperture.

An object of the present invention is to overcome the aforementioned problems and provide an access device with a highly compact access structure, which fulfils all of the necessary safety requirements. In particular, it is an object to provide an access device that can be stored wholly within the access aperture or above and within the door profile.

DESCRIPTION OF ONE EMBODIMENT OF THE INVENTION

The aforementioned objectives are achieved by provision of an access structure as described below.

In a first embodiment, the present invention relates to an extendable access device for gaining access to elevated locations via a hatch opening, comprising a telescopic ladder with a plurality of sliding elements movable between an extended position and a retracted position, each sliding element comprising two stiles connected by a rung, wherein the stiles of each sliding element are interlocked with the stiles of adjacent sliding elements, wherein each sliding element comprises a first locking mechanism for releasably connecting at least one of the stiles to an adjacent stile of an adjacent sliding element, the first locking mechanism being adapted to lock each sliding element in its retracted position, and wherein the first locking mechanism of each sliding element is adapted to releasably connect at least one stile of each sliding element to a stile of an adjacent sliding element, which is closer to a top end of the telescopic ladder, and is adapted to automatically disconnect said stiles once an adjacent sliding element, which is closer to a bottom end of the telescopic ladder, is in its extended position, and wherein the first locking mechanism is adapted to automatically connect the at least one stile of said sliding element to a stile of the adjacent sliding element, which is closer to a top end of the telescopic ladder, when the adjacent sliding element, which is closer to the bottom end of the telescopic ladder, is moved from its extended position towards its retracted position.

In another embodiment, the extendable access device comprises a second locking mechanism that is adapted to releasably connect at least one stile of each sliding element to a stile of the adjacent sliding element, which is closer to the bottom end of the telescopic ladder, when said sliding element is moved away from its retracted position.

According to another aspect, the second locking mechanism is adapted to automatically disconnect the at least one stile of each sliding element from the stile of the adjacent sliding element, which is closer to the bottom end of the telescopic ladder, when said sliding element is transferred from its extended position to its retracted position.

In a further embodiment, the first locking mechanism comprises a pivotable locking member that is moveable between a first position, in which the locking member connects the stile of a sliding member via positive locking with the stile of an adjacent sliding member that is closer to the top end of the telescopic ladder, and a second position, in which the stiles of said sliding members are disconnected, wherein the locking member is biased towards its second position.

In another alternative, the plurality of sliding elements are adapted to be moved from their retracted position to their extended position sequentially, wherein the sliding elements comprise a first sliding element, located at a bottom end of the ladder and adapted to be moved before the remaining sliding elements, the first sliding element comprising a third locking mechanism adapted to lock the first sliding element in its retracted position.

According to another embodiment, the telescopic ladder further comprises a non-slidable element pivotably attachable to the hatch opening, the non-slidable element comprising two stiles connected by a rung, the stiles of the non-slidable element being interlocked with the stiles of a last sliding element, which is located at a top end of the ladder, and wherein the third locking mechanism is constructed to remain locked until the telescopic ladder is pivoted, with respect to the hatch opening.

A further embodiment includes a third locking mechanism comprising a strap fixed to the non-slidable element at a first end and releasably attached to the first sliding element at an opposite, second end by means of a locking apparatus. The strap may extend past the second end to form a pulling means, which is adapted to facilitate pivoting of the telescopic ladder when being pulled by an operator. The locking apparatus may comprise two independent latches provided on the rung of the first sliding element and adapted to release the strap upon activation of both latches.

In another aspect, the third locking mechanism is constructed such that activation of the third locking mechanism causes the telescopic ladder to pivot.

In another embodiment, the extendable access device further comprises a pull wire adapted to control the pivoting movement of the telescopic ladder, and wherein the third locking mechanism comprises a sliding member, the sliding member being slidable from a first position, in which the third locking mechanism is locked, into a second position, in which the third locking mechanism is unlocked, and wherein the sliding member is attached to the pull wire such that moving the sliding member from its first position to its second position causes the pull wire to pivot the telescopic ladder downwards and vice versa.

According to a further alternative, the access device comprises a pivotable support frame having a first section connected to the telescopic ladder and a second section connectable to the hatch opening, the first section being attached to the second section via a pivot, and wherein the pull wire has a first end connected to the second section of the support frame and a second end connected to the sliding member via a pulley such that movement of the sliding member from its first position to its second position increases a wire length between the pulley and the first end of the wire, thereby allowing the telescopic ladder to pivot downwards, and vice versa.

In a further embodiment, the second end of the pull wire is attached to the sliding member by means of a sliding block, the sliding block being arranged in a guide slot of the second section of the pivotable support frame. The adjustable stop member may be located on the second section of the support frame and adapted to restrict movement of the sliding block within the guide slot.

In an alternative aspect, the access device comprises a pivotable support frame having a first section connected to a non-slidable element, which comprises two stiles connected by a rung, the stiles of the non-slidable element being interlocked with the stiles of a last sliding element, which is located at a top end of the ladder, and a second section connectable to the hatch opening, the first section being attached to the second section via a pivot. The first section of the pivotable support frame preferably comprises a length in direction of the ladder that is equal or shorter than the length of the stiles of the non-slidable element.

In another embodiment, the access device further comprises a mounting bracket adapted to be attached to the hatch opening by means of a mounting plate, wherein the second section of the support frame comprises a connector piece adapted to hook into the mounting bracket. The mounting plate preferably comprises two separate mounting pieces, preferably angled mounting pieces, such that the mounting plate can be adjusted to a width of the telescopic ladder.

In one embodiment of the present invention, the mounting bracket is a hook, which is releasably attached to the mounting plate, and wherein the connector piece is a pin member or connector bar adapted to be received by the hook.

In another aspect, the second section of the support frame further comprises a through-hole which is configured to receive a fastening member, preferably a threaded stud, of the mounting plate after the second section of the support frame is hooked into the mounting bracket.

According to a further embodiment, the access device comprises an automatic actuator adapted to sequentially, preferably continuously extend and/or retract the plurality of sliding elements of the telescopic ladder.

According to another embodiment of the present invention, the sliding elements of the telescopic ladder are constructed such that each sliding element feeds an adjacent sliding element to the automatic actuator, when said sliding elements is moved into its extended and/or retracted position.

In another aspect, each sliding element comprises at least one gear rack attached to at least one of the stiles, and wherein the actuator comprises a drive tube comprising a plurality of spur gears each of which is aligned with a corresponding gear rack of a sliding element and adapted to engage a respective gear rack.

Another embodiment includes that the gear racks are constructed such that gear racks of adjacent sliding elements overlap in a longitudinal direction by at least one gear tooth, when at least one of the adjacent sliding elements is in its extended position.

The Figures illustrate specific embodiments of the present extendable access device. In particular, the Figures show the following.

In conjunction with FIGS. 1, 2, 3, FIG. 17 illustrates the compact arrangement of the access device and cantilevered supporting means in an access aperture.

Figure 18:
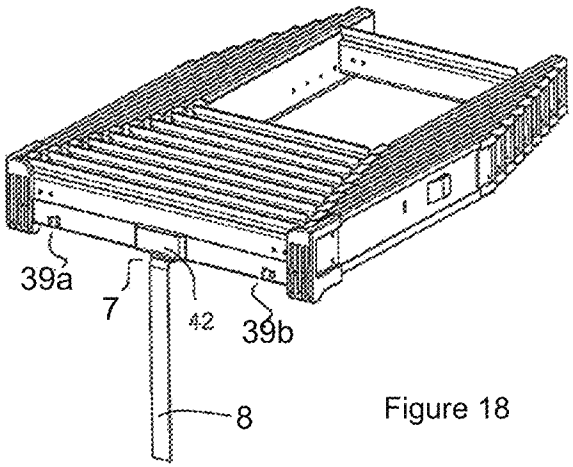
Figure 19:
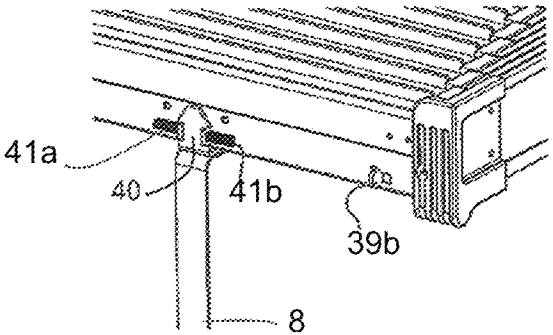
Figure 20:
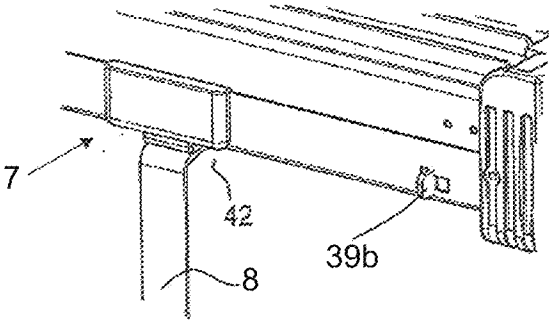

FIGS. 18, 19, and 20, illustrate a secure locking means for the retracted access device that requires two handed operation to unlock, release and extend the access device. FIGS. 19 and 20 show enlarged partial detail views of a part of what is illustrated in FIG. 18.

Figure 21:
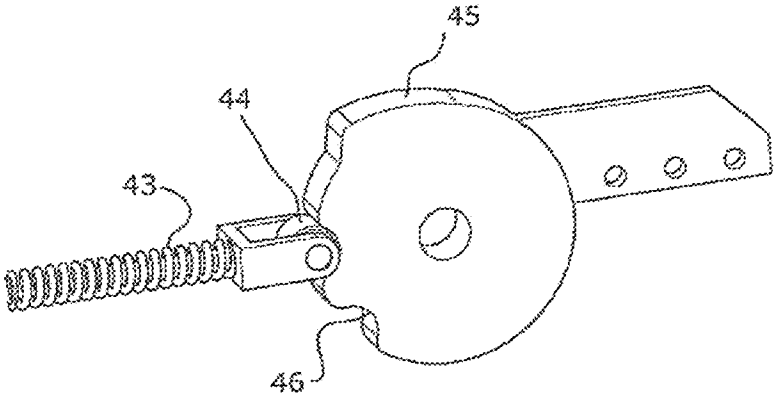

FIG. 21 shows an alternative spring biased pivot and supporting means using a spring biased roller or stop and indents to position the access structure and variable circumferential profiles to provide resistance and assistance to motion.

Figure 22:
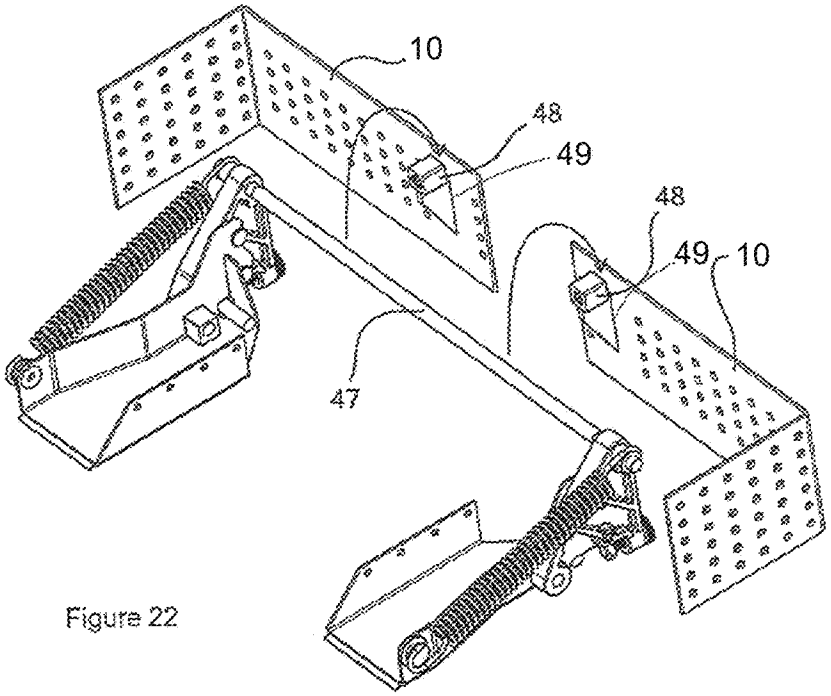

FIG. 22 shows a pair of mounting plates.

FIGS. 23 to 50 show details of a second embodiment of the present access device particularly one example of a powered automatic access device and some alternative configurations in whole or part.

Figure 23:
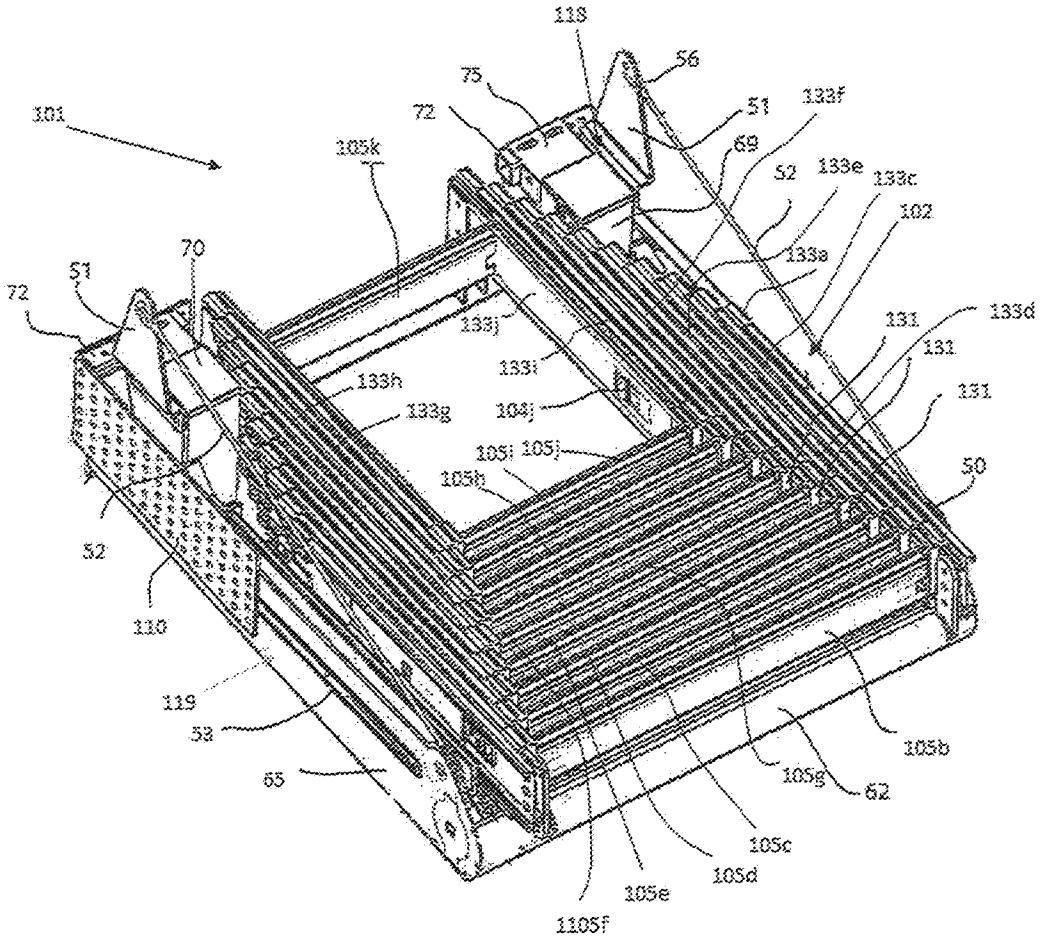

FIG. 23 shows one example of the powered automated access device in the closed format with the mounting brackets before fitting to an access aperture.

Figure 24:
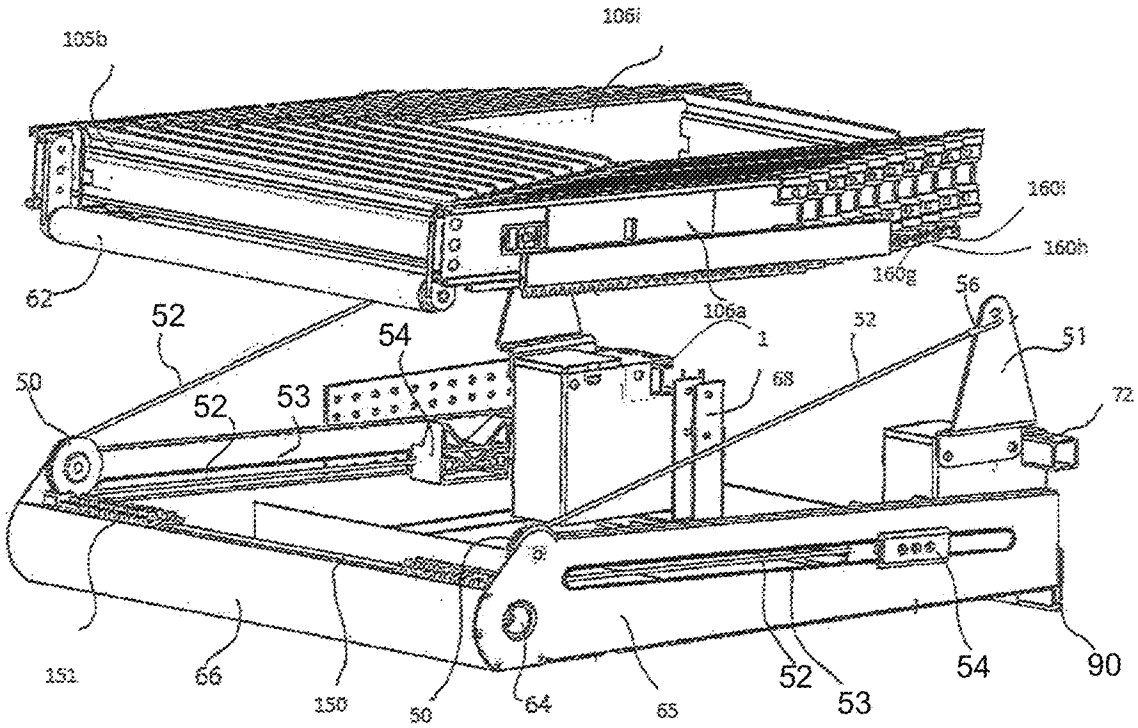

FIG. 24 shows the powered automatic access device in the closed format with the ladder assembly separated from the supporting pivotal frame and powered drive assembly.

Figure 25:
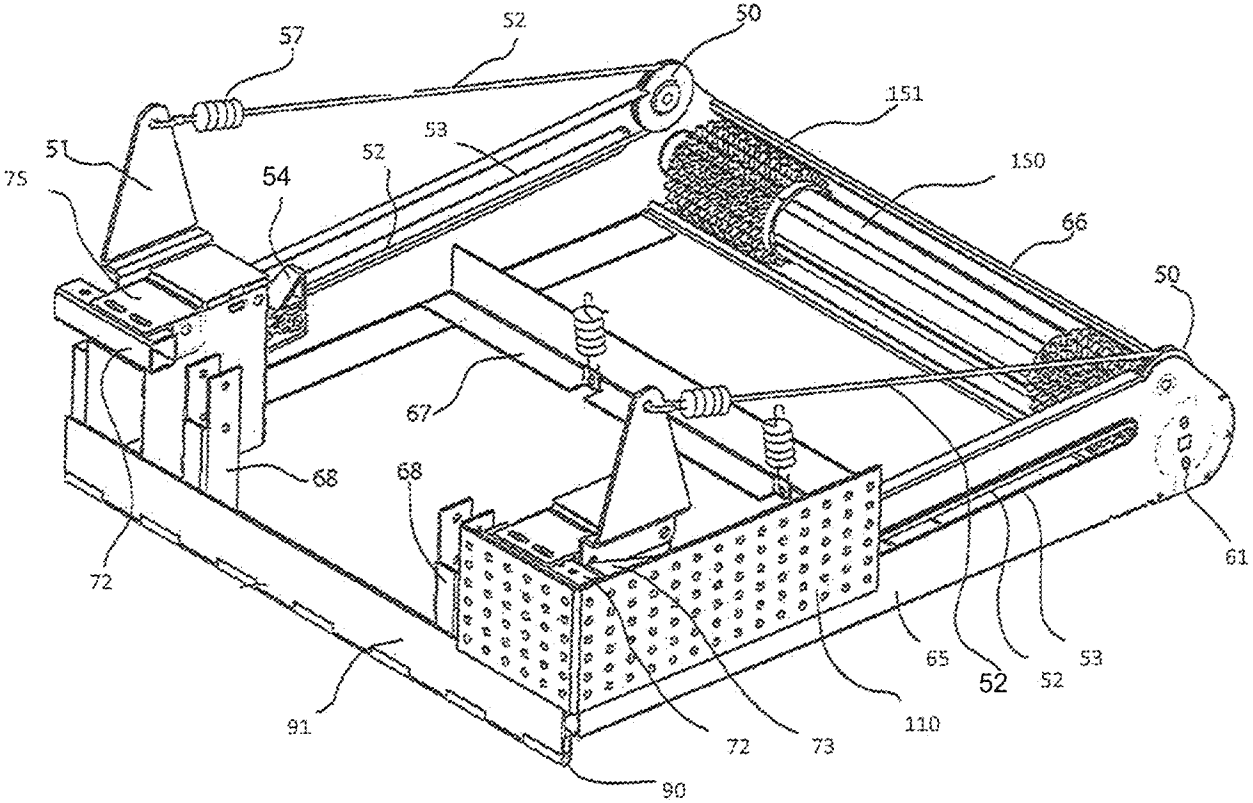

FIG. 25 is a part view of the frame assembly showing the detachably attached mounting and release means for the powered automatic access device.

Figure 26:
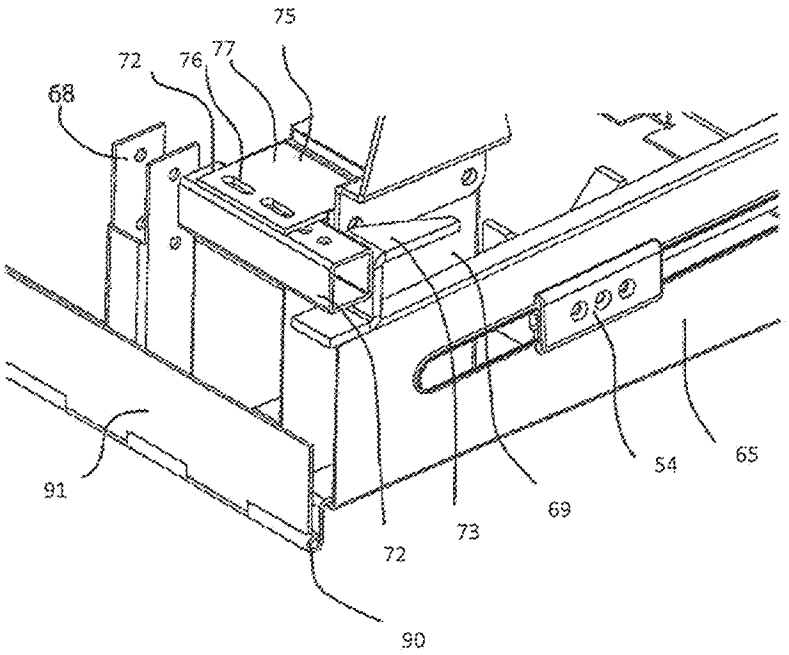

FIG. 26 shows in more detail a corner of the frame assembly showing the sliding block and slot.

Figure 27:
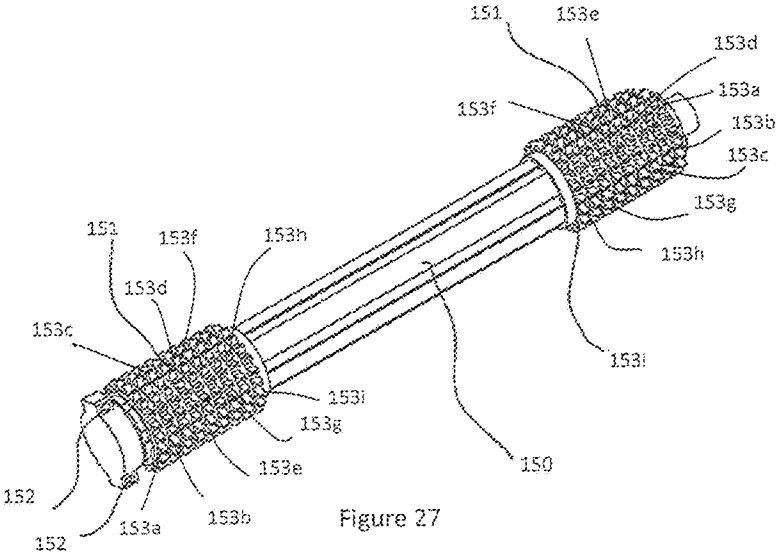

FIG. 27 shows a powered drive assembly including, the motor drive tube, gear clusters, and adjustment for controlling the number of clockwise or anti-clockwise rotations.

Figure 28:
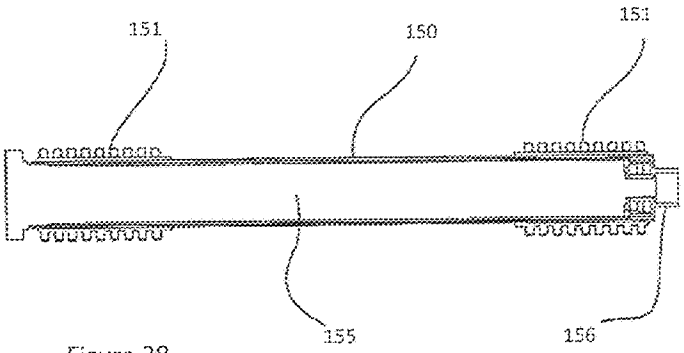

FIG. 28 shows a sectional view of the motor drive assembly and the supporting bearing means.

Figure 29:
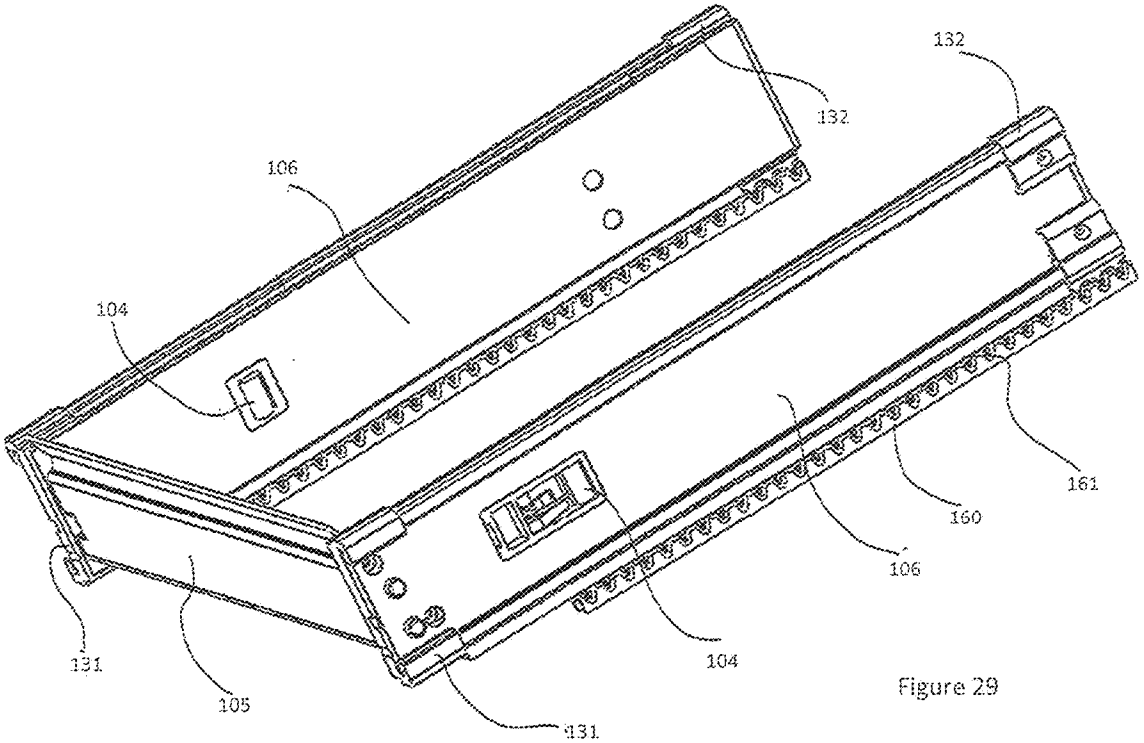

FIG. 29 is an illustration of a sliding element forming part of an extending ladder or stairs, in which is shown the sliding dynamic element of the duplex bearing, the latching assembly and the gear racks.

Figure 30:
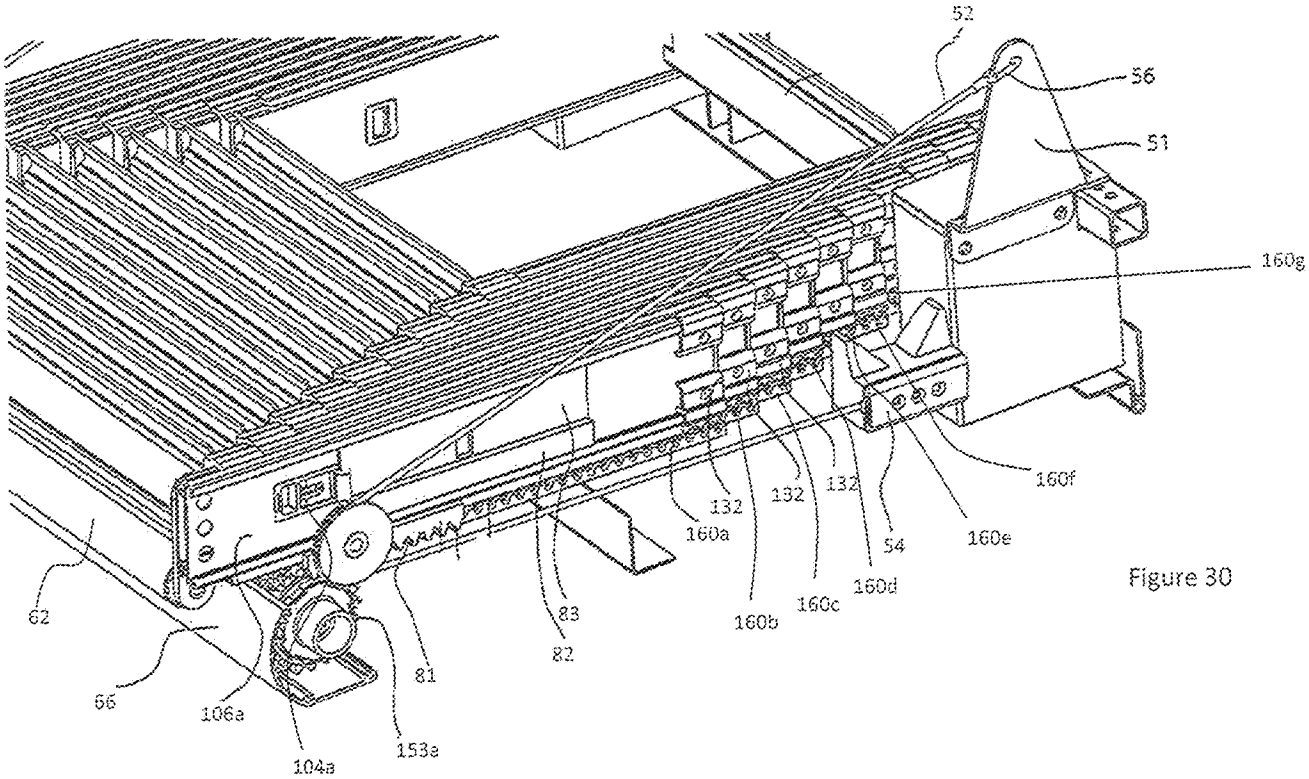

FIG. 30 illustrates the powered automatic access assembly with one frame side cover and mounting plate removed to show the means by which the ladder, door and frame are automatically lowered.

Figure 32:
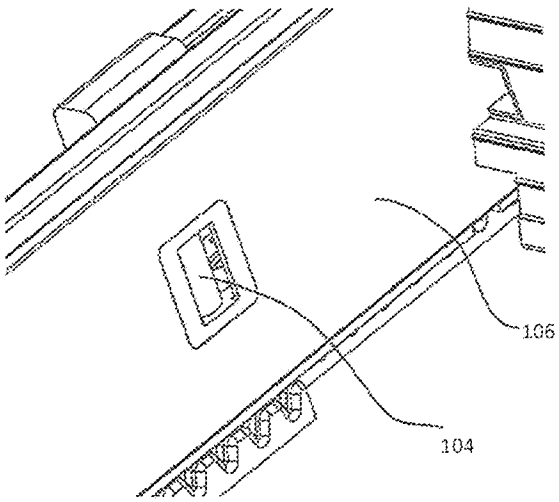
Figure 31:
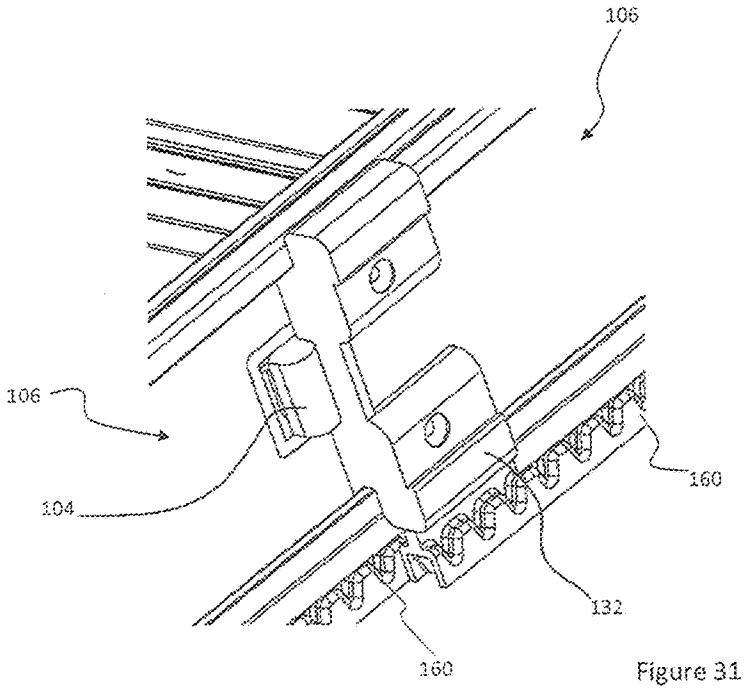

FIGS. 31 and 32 show the locking or latching means from either side of the stile in the unlocked or disengaged position providing the latching means.

Figure 33:
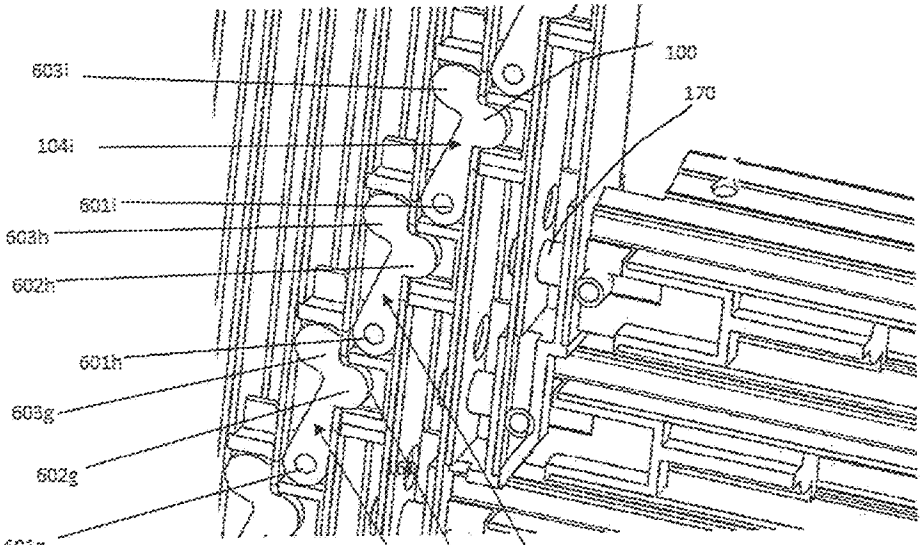

FIG. 33 is a sectional view through sliding elements showing the latches in the locked position and held in that position by the adjacent stile.

Figure 35:
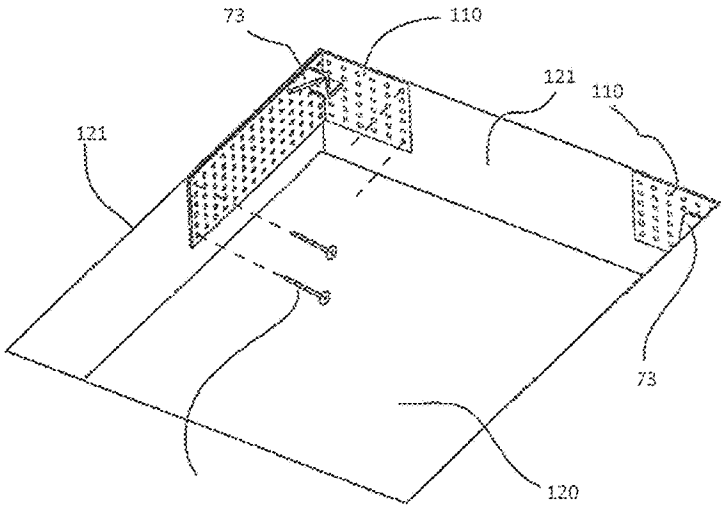
Figure 34:
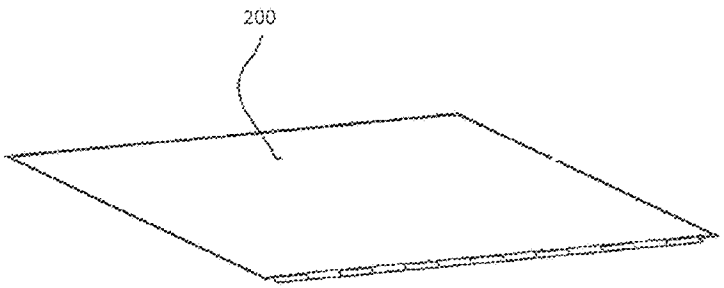

FIGS. 34 and 35 show the mounting and access aperture for the powered automatic access device, FIG. 34 shows the aperture in a ceiling closed by the door and FIG. 35 shows the upper side of the aperture with the detachably attached mounting brackets fitted in adjacent corners and also acting as a reinforcing means for the aperture structure.

Figure 37:
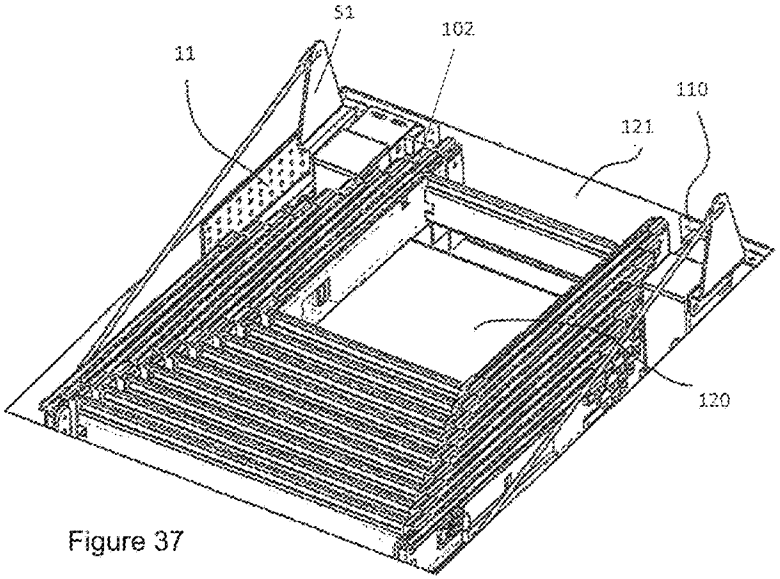
Figure 36:
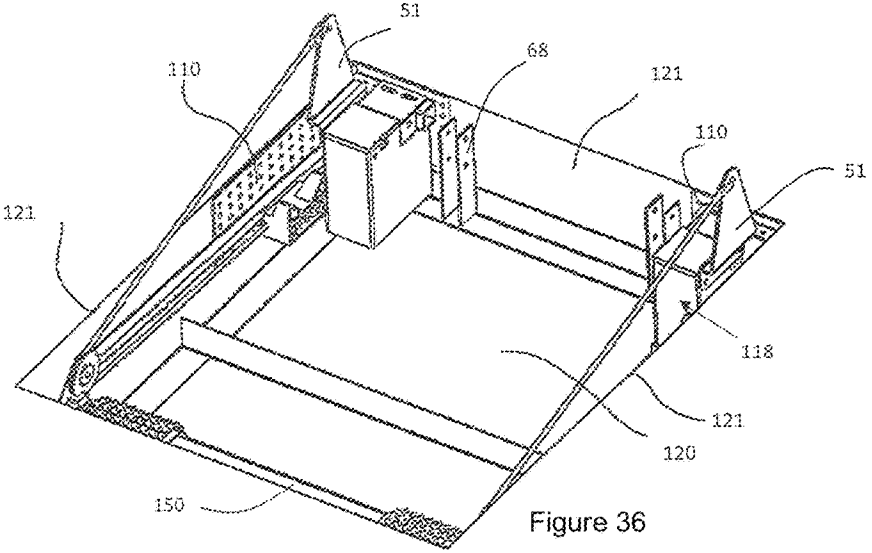

FIGS. 36 and 37 show the powered automatic access device fitted onto the mounting plates in the aperture. FIG. 36 has the ladder assembly removed to show the mounting plates, the opening and closing means, the ladder mountings, and frame assembly with holes for fixing the door or panel.

Figure 38:
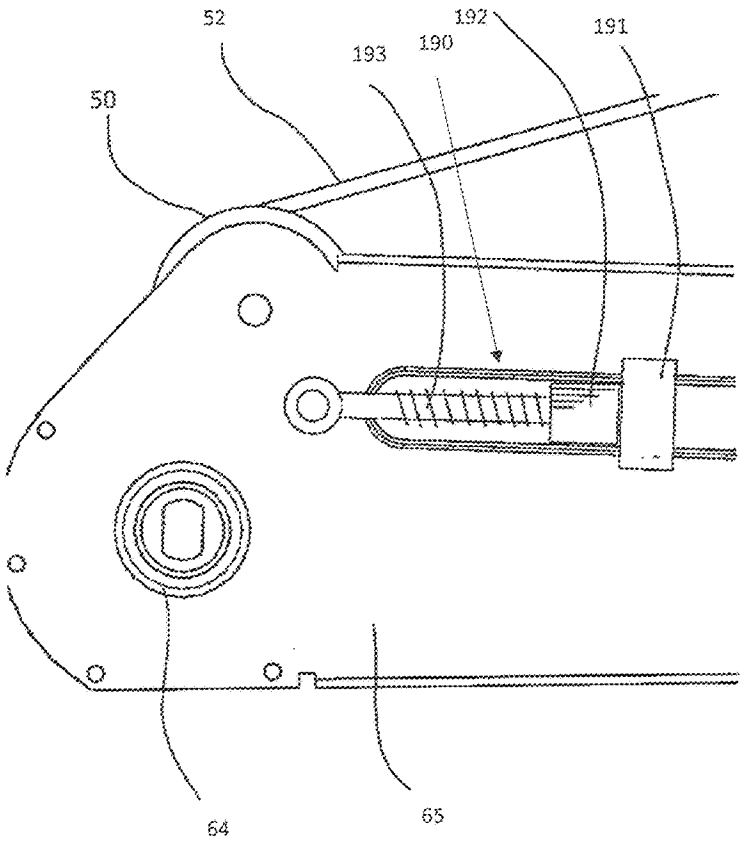

FIG. 38 shows an adjustable stop for the slide which provides the adjustment means, to match the ladder working height with the distance between the two adjoined access levels. It also shows a supporting journal for the motor drive bearing.

Figure 39:
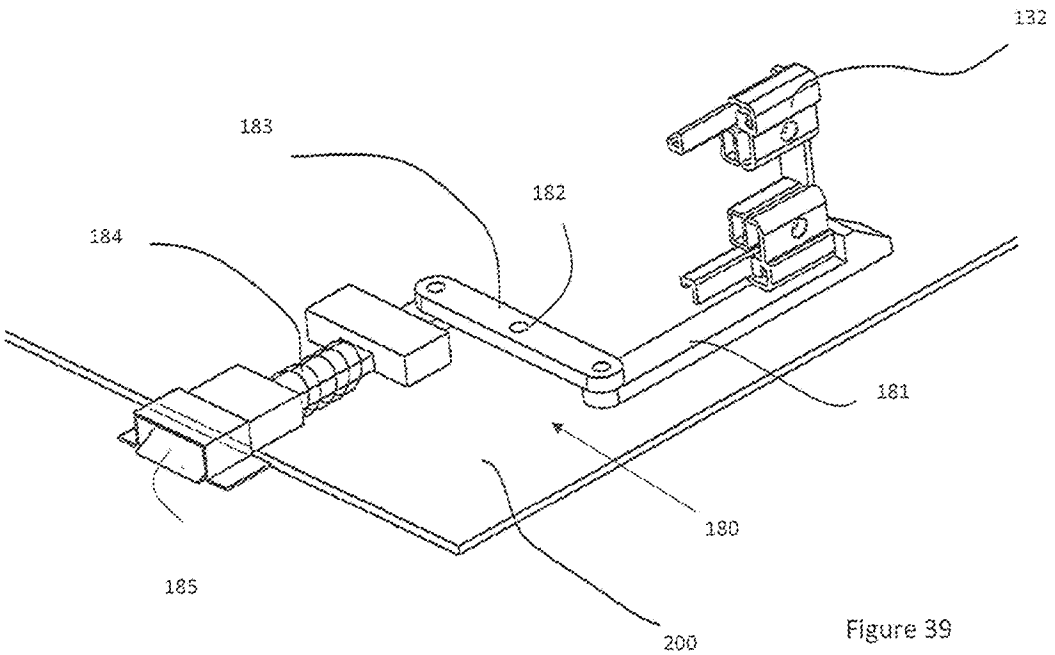

FIG. 39 shows a mechanism for locking the door operated by the sliding action of the extendible ladder means.

Figure 40:
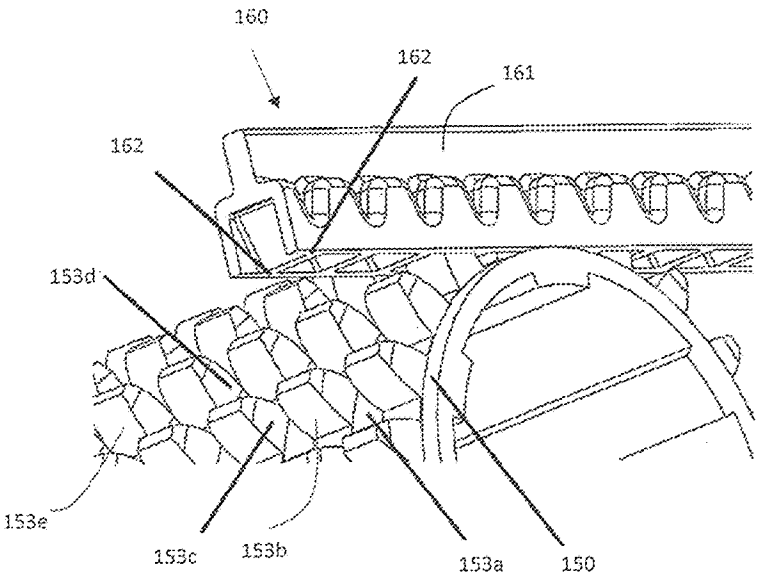

FIG. 40 is an illustration of one configuration of the rack and pinion drive, gear and gear rack that extends the ladder and opens and closes the powered automatic access device and door. The illustration also shows the interlocking arrangement for the spur gear cluster to fit onto the drive tube.

Figure 41:
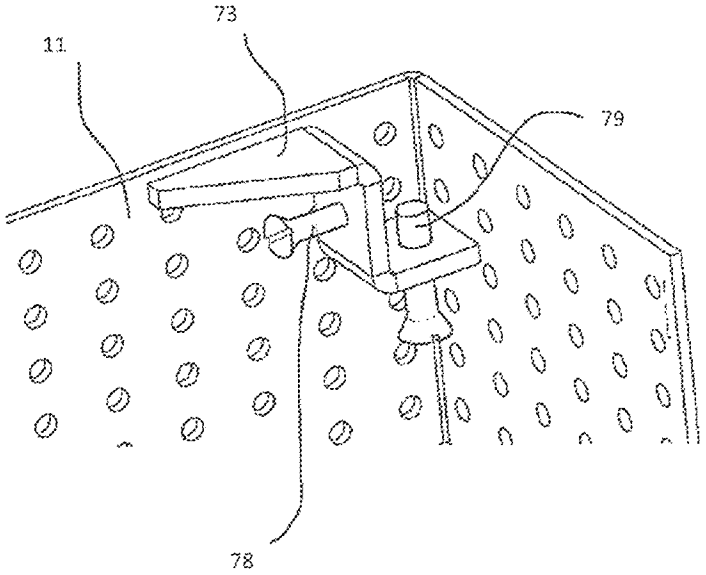

FIG. 41 shows the mounting and reinforcing plate with the arrangement for the fitting of the powered automatic access device, and also shows the adjustment means for aligning the assembly in the aperture and the safety retaining means for securing the assembly in the aperture.

Figure 42:
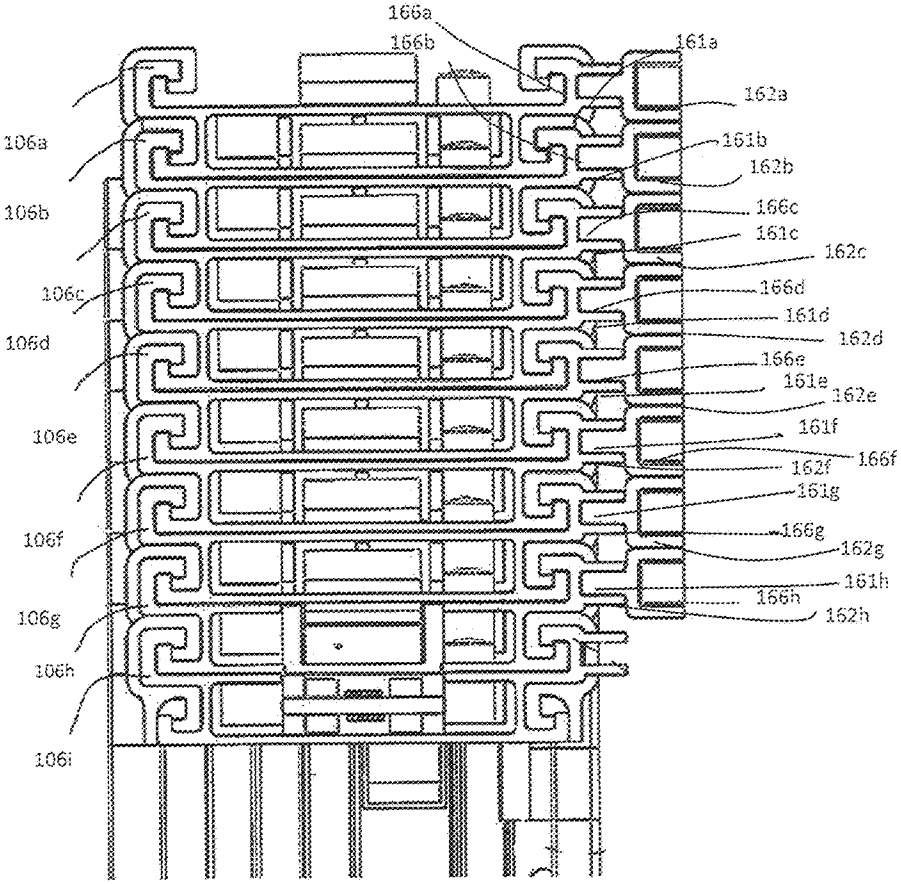

FIG. 42 shows interlocking stile elements offset from one another and separated by the dynamic bearing forming part of the duplex bearing arrangement.

Figure 43:
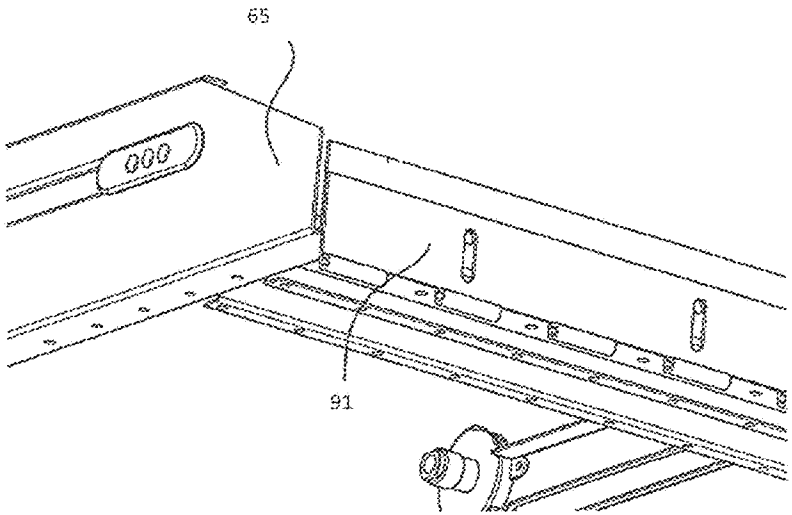

FIG. 43 show means for adjusting the pivotal supporting frame to accept different thicknesses and types of door construction.

Figure 45:
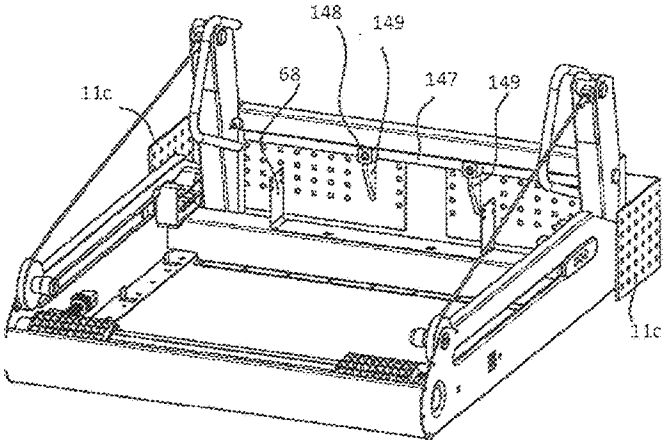
Figure 44:
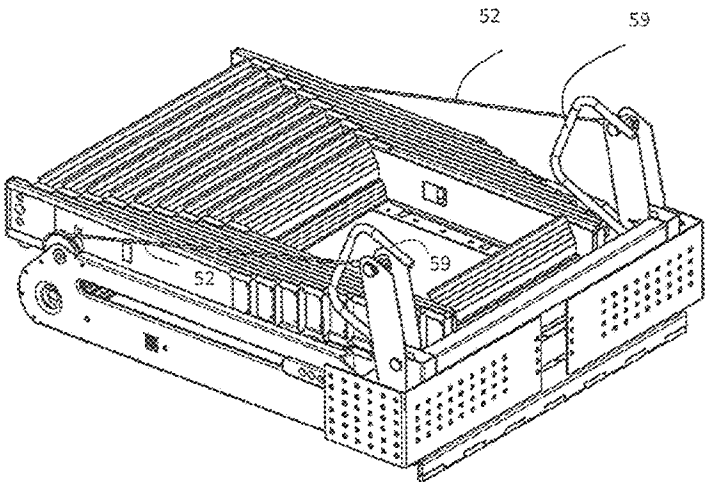

FIGS. 44 and 45 show alternative means for the rapid installation or release of the powered automatic access device.

Figure 47:
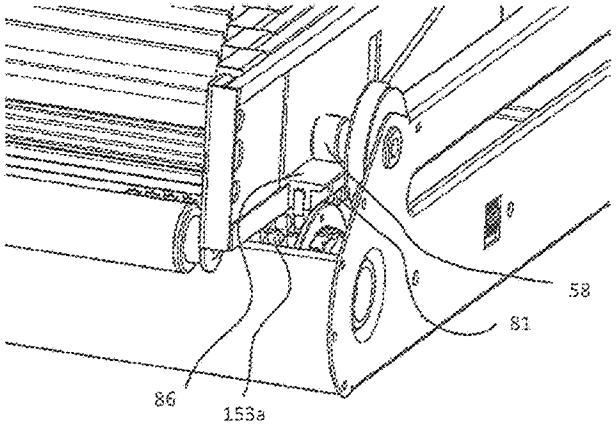
Figure 46:
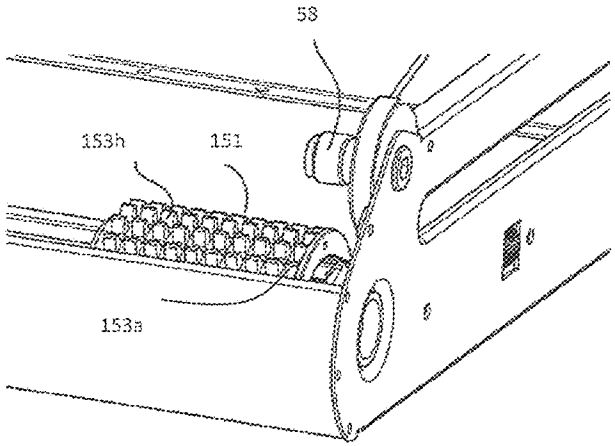

FIGS. 46 and 47 show a means of mechanically aligning and retaining the drive and driven gears.

Figure 48:
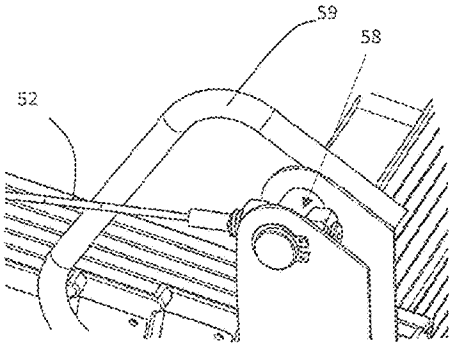

FIG. 48 shows means to adjust the length of the flexible supports.

Figure 50:
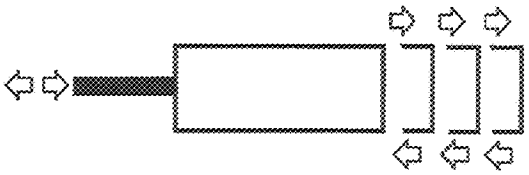
Figure 49:
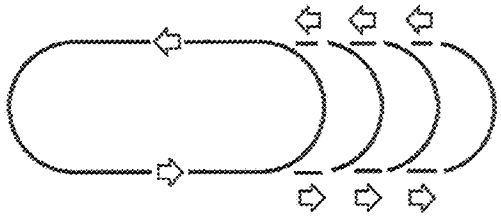

FIGS. 49 and 50 illustrate two operating cycles for the driving means for the automatic access device.

FIGS. 1 to 6 illustrate a first embodiment for the access device of the present invention and mountings where the access device is an extendable and retractable ladder the construction of which enables all the supporting and spring biasing pivoting means to be configured and located within the three principal Cartesian coordinates of the access device itself. In such a configuration the aperture can be almost that of the dimensions of the access device allowing for a working clearance on the un-mounted surfaces.

In the first embodiment of the access device, the access device 1 comprises a telescopic ladder 2 where the stiles 6 are of identical or similar profile being interlocked with each adjacent stile 6. The stiles of the first embodiment are shown to be offset sideways from each adjacent stile to form a staggered telescopic ladder. The person skilled in the art will understand that the stiles could also be constructed as concentric elements, such as tubes, which are arranged inside each other.

In this embodiment of the invention the access device, a telescopic ladder consists of a plurality or sliding elements 33*a* to 33*i*, each constructed from two generally parallel stiles 6*a* to 6*i*, connected by rungs 5*b* to 5*i*, particularly at the bottom end of each individual stile 6*a* to 6*i*. The sliding elements can be moved from a retracted position to an extended position. The sliding elements further comprise top caps 31 and bottom caps 32, forming protective ends and sliding bearings that facilitate sliding movement of the sliding elements 33*a* to 33*i* with respect to each other, while keeping the sliding elements interlocked with their adjacent sliding elements 33*a* to 33*i*.

Figure 6:
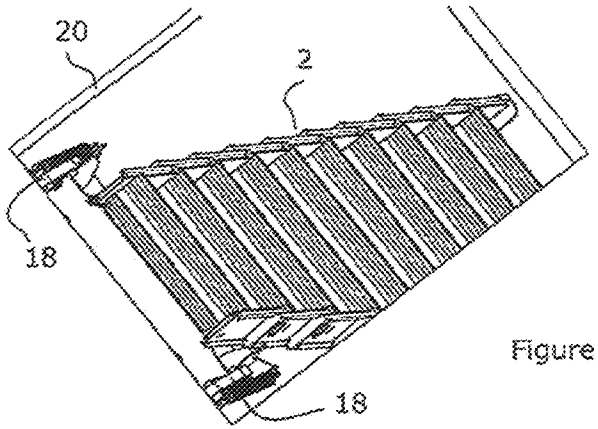
FIGS. 6 and 7 show the access device mounted within the access aperture of a structure with the access device lowered to an operation position and fully extended.
Figure 7:
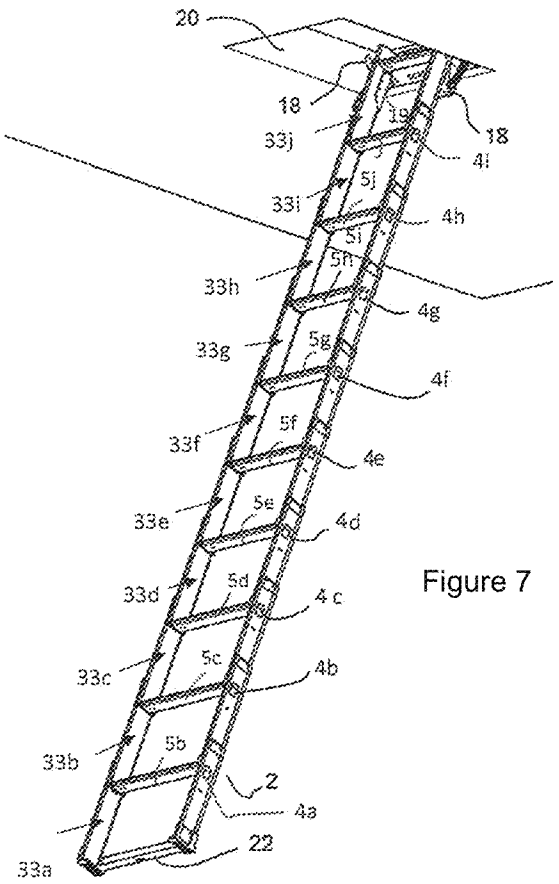
Figure 8:
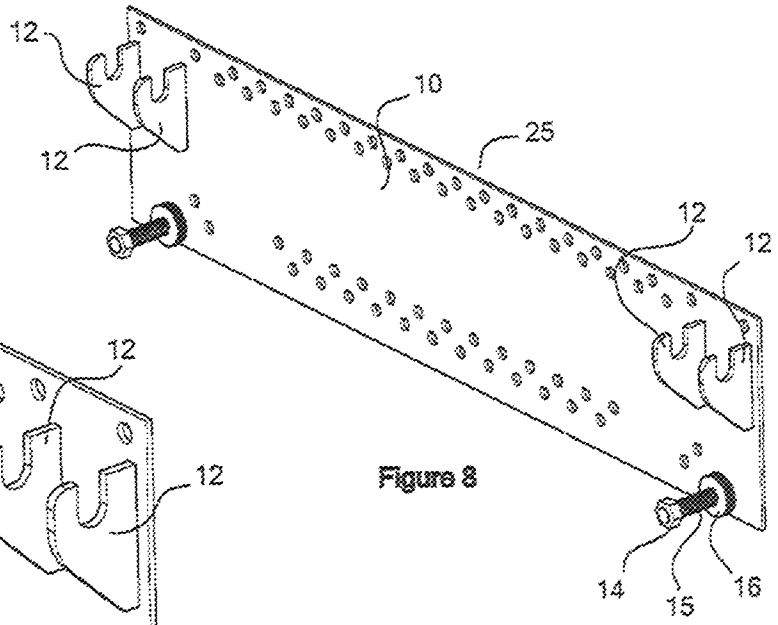
FIGS. 8 and 9 show the attachment means, adjustment and retention of the access device and pivotal support.
Figure 9:
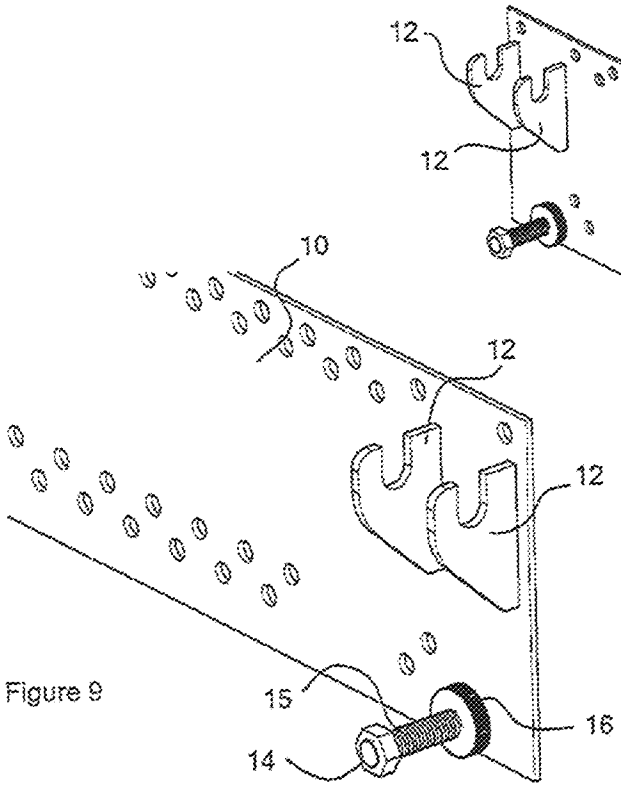

As will be explained in more detail with reference to FIG. 6, each sliding element 33*a* to 33*i* has a first locking mechanism, particularly a spring biased locking member 4*a* to 4*i* that is constructed to extend into mating holes in the adjacent sliding element to lock together adjacent elements as the respective sliding members are fully retracted and, at the same time, disengage from the mating hole when an adjacent sliding member, which is located further to the bottom end of the ladder, reaches its extended position.

On the outermost, first sliding element 33*a*, that is the sliding element that is located at the bottom of the telescopic ladder 2, the stiles 6*a*, are connected by a rung that is a reinforcement member 22, rather than a step to improve the rigidity of the bottom sliding element and telescopic ladder 2. Of course, the rung of the first sliding element 33*a* could also be constructed as a step, similar to rungs 5*b* to 5*i* of the remaining sliding elements 33*b* to 33*i*. At the bottom of the outermost, first sliding element 33*a* feet 3 are provided, which are preferably designed to prevent wear of the flooring the ladder is intended to stand on.

Figure 3:
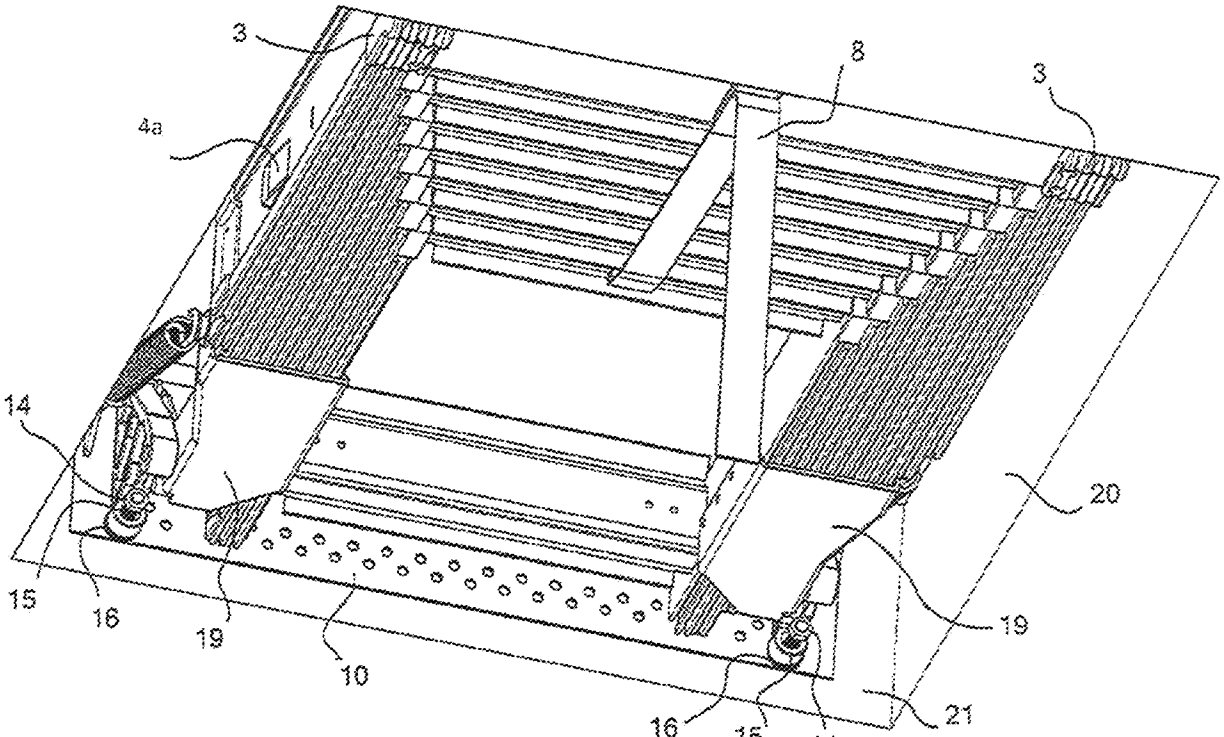
FIG. 3 shows the access device mounted within the access aperture of a structure viewed from below the aperture.
Figure 4:
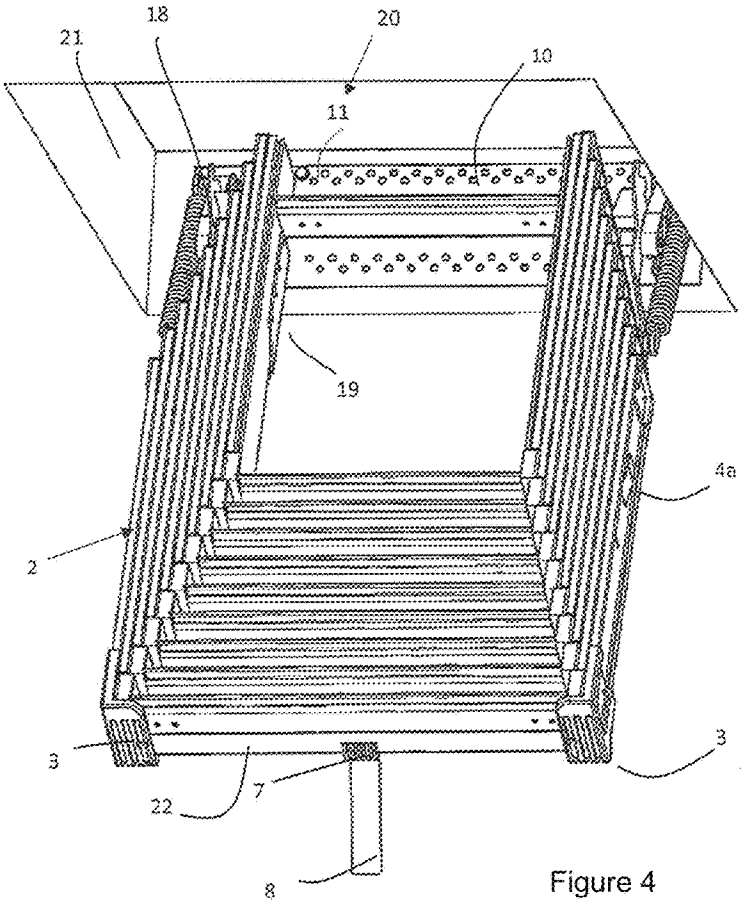
FIG. 4 shows the access device mounted within the access aperture of a structure with the access device and mounting assembly lowered to an operating position and the access device, in this instance a ladder, still fully retracted and locked.
Figure 5:
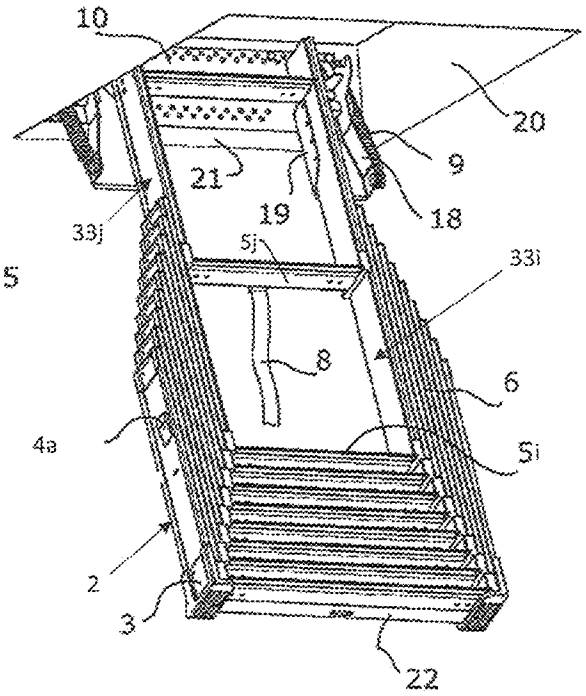
FIG. 5 shows the access device mounted within an access aperture of a structure with the access device and mounting assembly lowered to an operating position, access device unlocked and partially extended.

The extendable and retractable access device 1 is fixed to a mounting assembly 25 at one end by means of a pivotable support frame, comprising a first section 19 that is pivotally connected to the second section 18 via a pivot 17. The second section 18 is located or hooked into an anchor or mounting plate 10, by means of mounting brackets 12, which in the first embodiment are constructed as hooks. The mounting plate 10 can be fixed to a structure or surface 21 in an access aperture 20 of a hatch opening (FIGS. 3 and 4).

In the first embodiment, the second section 18 of the pivotable support frame is constructed as a triangular cantilevered structure that is pivotably connected to a first section 19 of the support frame via a pivot 17. The first section 19 of the support frame can be a pivot plate, which is attached to a non-slidable element 33*j* of the ladder 2. The supporting frame is biased towards the vertical position, shown in FIG. 1, by means of a tension spring 9.

Figure 1:
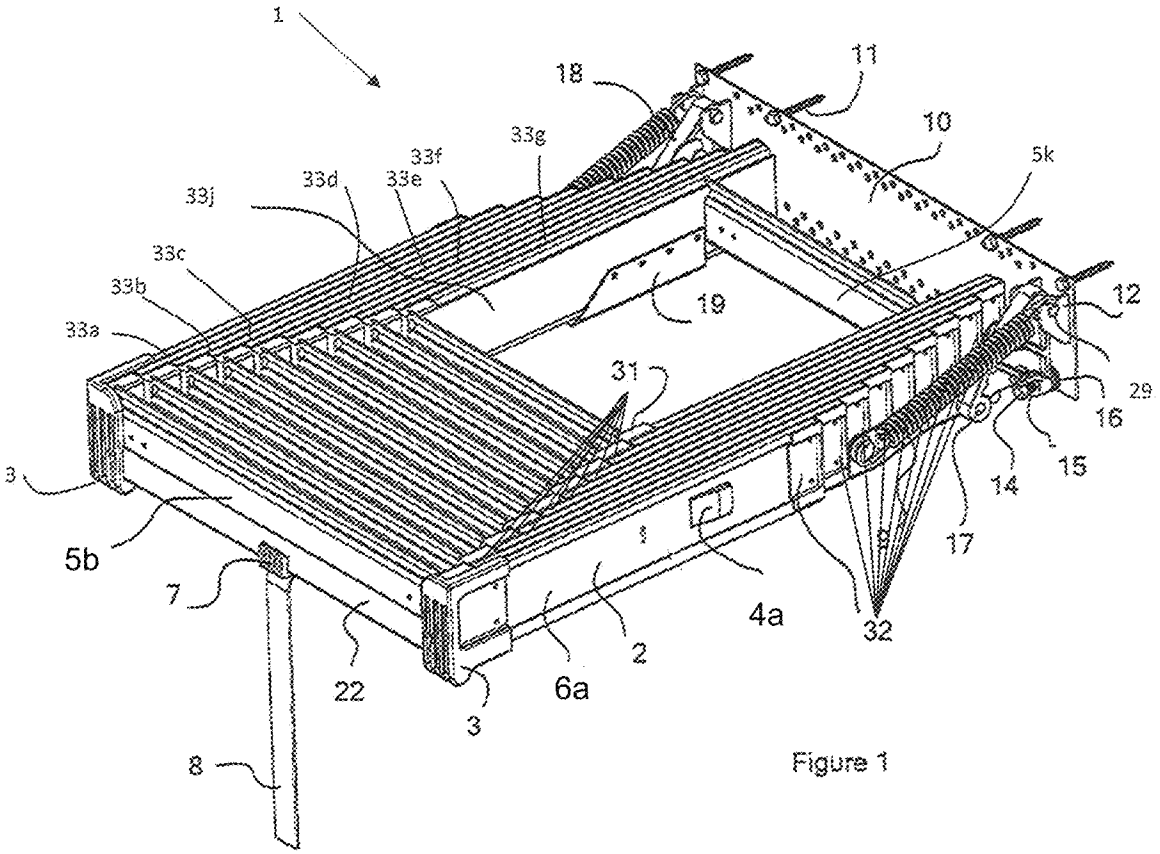
FIG. 1 shows a first embodiment of the present access device, a telescopic ladder, a cantilevered spring bias pivotal supporting means, the detachably attached mounting means, the adjustment means and the mounting means to the structure or surface to which the assembly is attached.
Figure 2:
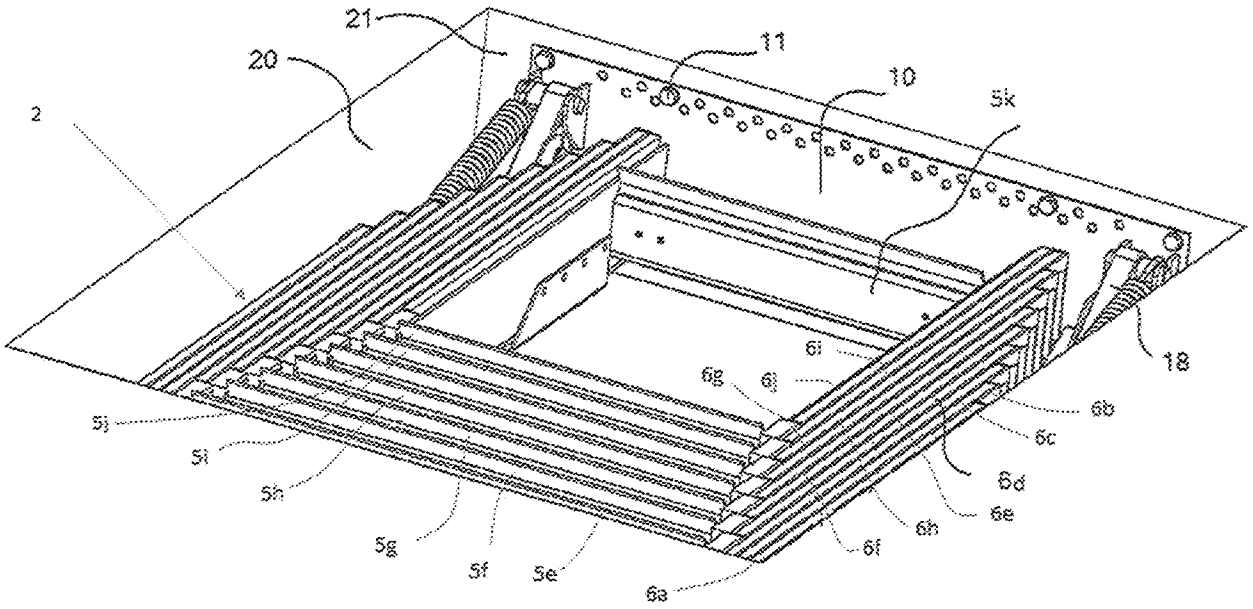
FIG. 2 shows the access device mounted within the access aperture of a structure viewed from above the aperture.

When the ladder 2 is in its retracted state, as shown in FIG. 1, the stiles 6*a* to 6*i* of each sliding element 33*a* to 33*i* are releasably connected to stiles 6*a* to 6*i* of an adjacent sliding element 33*a* to 33*i* by means of a first locking mechanism. The function of the first locking mechanism can be derived from FIG. 33, which shows stiles 6*g*, 6*h* and 6*i* being in the retracted position of the respective sliding elements. Each of the stiles 6*g*, 6*h* and 6*i* comprises a locking member 4*g*, 4*h*, 4*i*, which is designed as a pivotable toggle, which is pivotable about pivot 601*g*, 601*h*, 601*i*. In the example of locking member 4*g*, it can be derived that a first protrusion 602*g*, 602*h* and 602*i* of locking member 4*g* extends into a mating hole 604*h*, within stile 6*h*, thereby connecting stile 6*g* to adjacent stile 6*h*. The locking member 4*g* is pushed into this first position within mating hole 604*h* by adjacent stile 6*f*, which is part of the sliding element 33*f* that is arranged further to the bottom end of the ladder 2. Consequently, locking member 4*g* will remain in mating hole 604*h* for as long as sliding element 33*f* in its retracted position. If sliding element 33*f* is moved into its extended position (not shown), locking member 4*g* will be able to move away from mating hole 604*h* into a second position in which second protrusion 603*g*, 603*h* and 603*i* protrudes out of stile 6*g* as shown in FIG. 31, for example. To this end, locking member is biased towards the second position shown in FIG. 32 by virtue of a coil spring attached to pivot 601*g*. Accordingly, due to the first locking mechanism, the sliding elements 33*a* to 33*i* can only be extended sequentially one after another, i.e. once the previous sliding element is fully extended.

As each sliding element 33*a* to 33*i* is extended it automatically locks onto the adjacent, previously extended sliding element 33*a* to 33*i* by means of a second locking mechanism until the ladder 2 is fully extended and locked ready to use.

When retracting the ladder 2 the top caps 31 engage and push the locking members 4*a* to 4*i*, thereby locking the respective sliding elements 33*a* to 33*i* to their adjacent, previously retracted sliding elements, until the ladder is fully retracted.

The reinforcement member 22, provides attachment means for a third locking mechanism, comprising strap 8 that is connected to a locking apparatus 7, one end of the strap 8 is fixed to the rung 5*i*, on the uppermost ladder element, which in turn is attached to the second section 18. The other end of the strap 8 extends past the locking apparatus 7, to enable the user of the access device 1 to pull the entire assembly down from the spring biased location in the access aperture 20 where it is stored. The strap 8 with the locking apparatus 7 engaged prevents the retracted or nested ladder 2 from opening as it pivots and lowers to an operational position.

In most configurations of the cantilever supported arrangement for the access device the support frame is attached to the first or uppermost element on the access device, which is a non-slidable element 33*j* that comprises a pair of stiles 6*j* connected by a rung 5*j*. Another top rung 5*k* may be mounted at the top end of the stiles 6*j* to provide a further step for the user. In the first embodiment, the access device is a telescopic ladder with offset interlocking sliding stiles 6*a* to 6*j* but any extendable and retractable access means can be attached to the supporting means such as or similar to the one described here. There are concentric tube telescopic ladders and concertina linkage ladders and others.

In the first embodiment of the invention the top or non-slidable element 33*j* of the ladder 2 is fixed to the first section 19 of the support frame, which is constructed as pivoting plates, so the rest of the ladder, that is the sliding elements 33*a* to 33*i*, is supported as a cantilevered structure or assembly from these plates. In other words, the plates of the first section 19 are only directly attached to the non-slidable element 33*j* and do not extend beyond the stiles 6*j* of the non-slidable element 33*j*, which renders the access device particularly compact.

On both the first section 19 and the second section 18 of the support structure, there are mounting pins, 29 and 35 for the tension spring 9. In the stored and retracted mode for the access device the hinge assembly has stops 30 that hold the ladder 2 nominally about at 90 degrees to the mounting plates 10 and surface 21. The spring is pretensioned to support the weight of the ladder and supporting assembly and as a safety feature two stops 30 are used, each having retaining heads to prevent the pivoting plates of the first section from bursting open, should there be any failure of the access device 1.

Stops 27 bearing on surfaces 28, prevent the over rotation of the pivoting plates and ladder 2, without restricting the ladder 2 being used in the statutory or recommended operational positions. The second sections 18 have mirror imaged features so they can by constructed to form left and right handed forms of the support frame.

Through-hole 34, or this can alternatively be an open slot, provides retaining and securing means to fix the supporting structure easily and rapidly to one or a pair of anchor or mounting plates 10, that are previously attached to the access aperture surface 21 or structure. To install the access device, 1, to the surface 21 of an access aperture 20, or to a structure the anchor or mounting plate 10, is first located and secured using a plurality of fastening member 11, the fastening members 11 being of any suitable type to provide secure anchorage.

In some instances where the surface 21 of the aperture 20, is structurally or geometrically inadequate a pair of mounting plates 10 (FIG. 22), particularly angled mounting plates 10, with two faces at 90 degrees can be used to install the access device 1. Each mounting plate comprises receiving means 48 attached via connectors 49 to the respective mounting plate 10 for receiving a pin member 29 or connector bar 47 of the second section 18 of the support frame. The additional surface on each plate allows the plate to provide mechanical integrity and geometric alignment at the respective corners of the aperture and additionally allows the exclusive axially loads on the fixing screws as occurs on the single plate to be transferred partially or wholly to fixing along each side of the access device 1, such that these side fixings take load in shear rather than axially. The integrity of the fasteners being more reliable.

Figure 10:
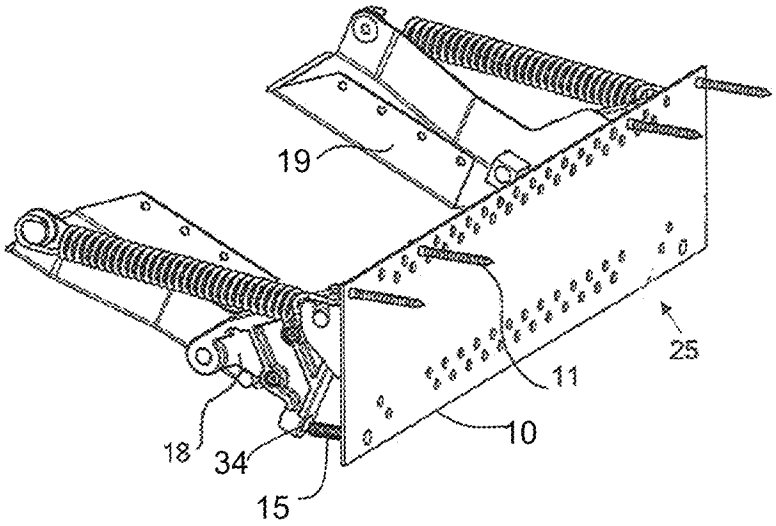
FIGS. 10, 11, 12, 13 and 14 show details of the mounting, adjustment, pivoting and spring biasing means for the access device supporting assemblies and the means by which the ladder and spring biased pivotal supporting means is located, hooked onto the mounting or anchor plate and retained.
Figure 11:
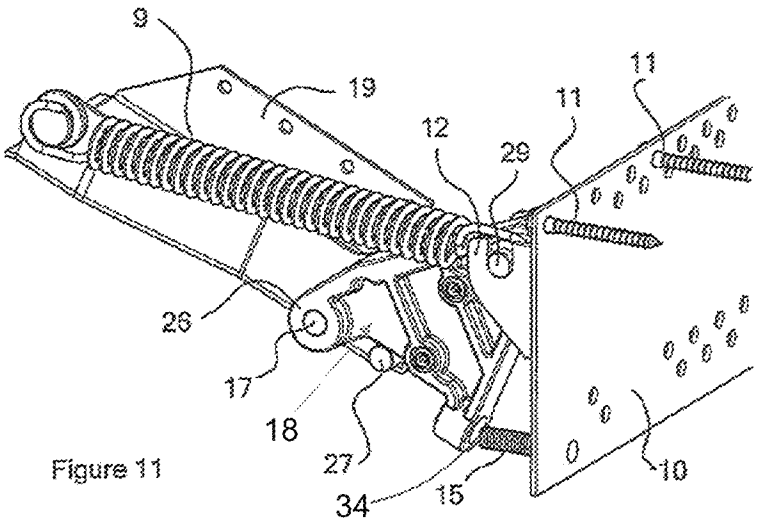
Figure 12:
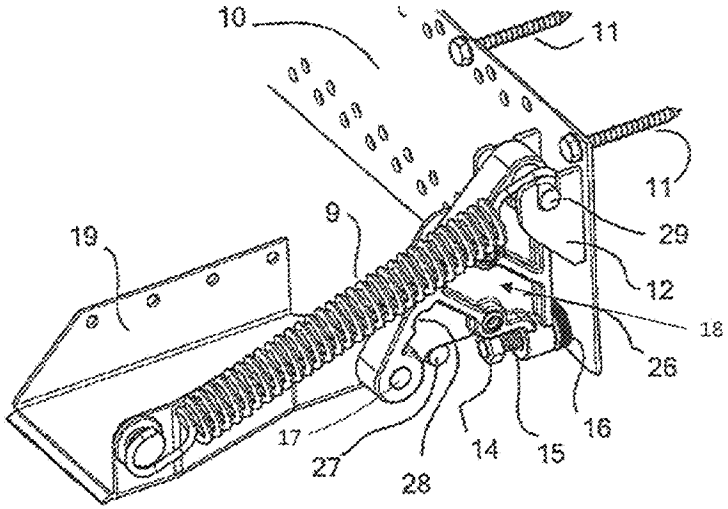
Figure 13:
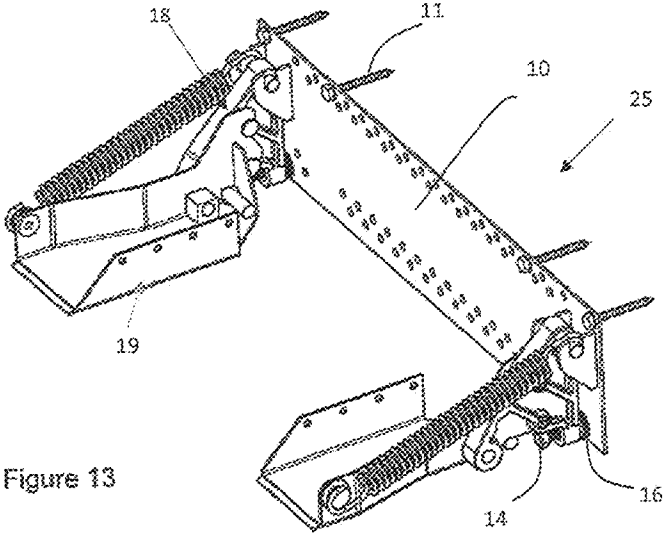
Figure 14:
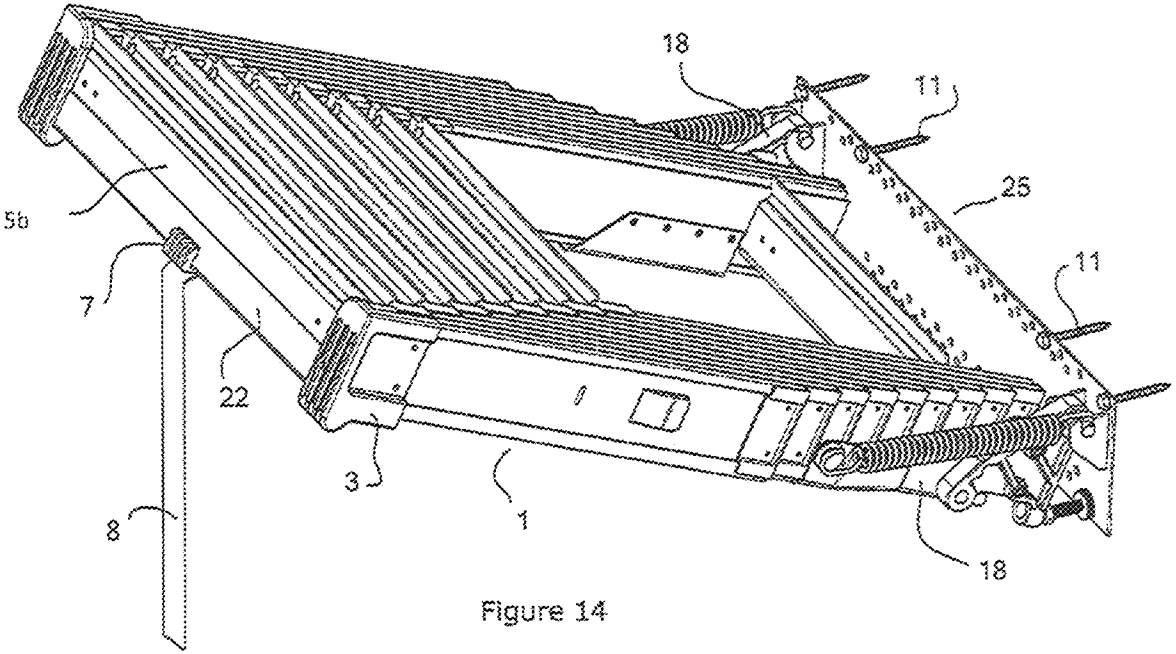
Figure 15:
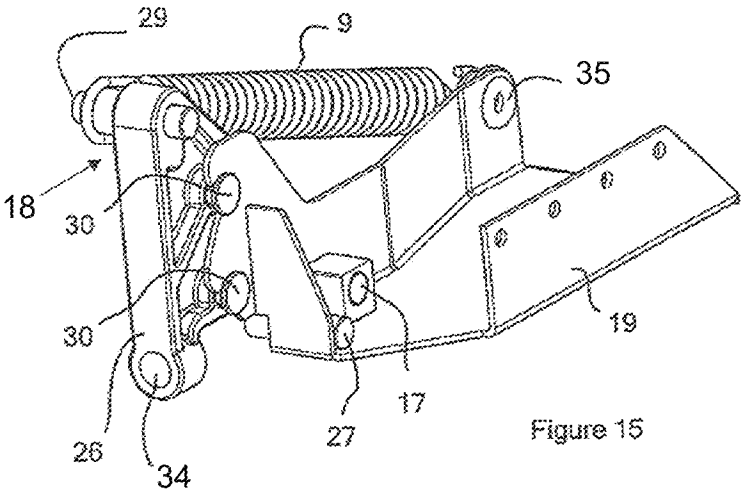
FIGS. 15 and 16 show details of the spring biased pivotal supporting means for the access device.
Figure 16:
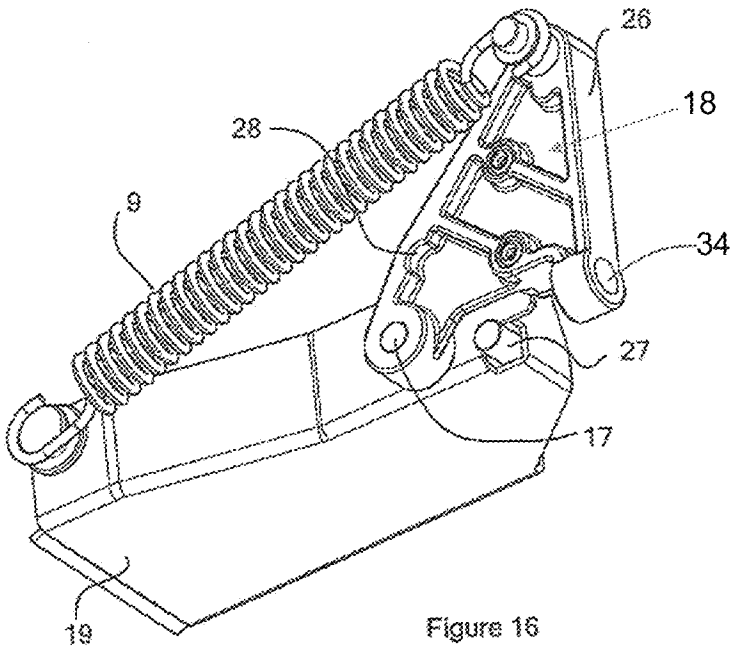

With the mounting or anchor plate assembly 25, the whole access device 1 can be hooked on to the plate as a single unit by locating pins 29 or connector bar 47 into receiving means 12 (hooks) or 48, as shown in FIGS. 10 and 12. Subsequently, as shown in FIGS. 11 and 13, with the pins 29 or connector bar 47 fully located within the receiving means 12 or 48, the access assembly is rotated, such that through-hole 34 fits onto the threaded studs 15 until the contact surfaces 26 rest on corresponding adjuster nuts 16. Adjuster nuts 16 can be used to adjust the angle at which the support frame and thereby the access device is attached to the mounting assembly. During the aforementioned process, the retaining or safety nuts 14 are removed from the threaded studs 15 and screwed back on to secure the support frame in place.

With the access device 1 hooked and lowered onto the threaded studs 15, the adjuster nuts 16 can be rotated to align the access device 1 to the structure or mounting surface 21. Once the correct alignment is achieved the retaining or safety nuts 14 are screwed on to the threaded studs 15 and tightened. The access device 1 is now secured onto the mounting or anchor plate 10 and cannot be inadvertently removed or displaced from the receiving means 12 or 48.

Figure 17:
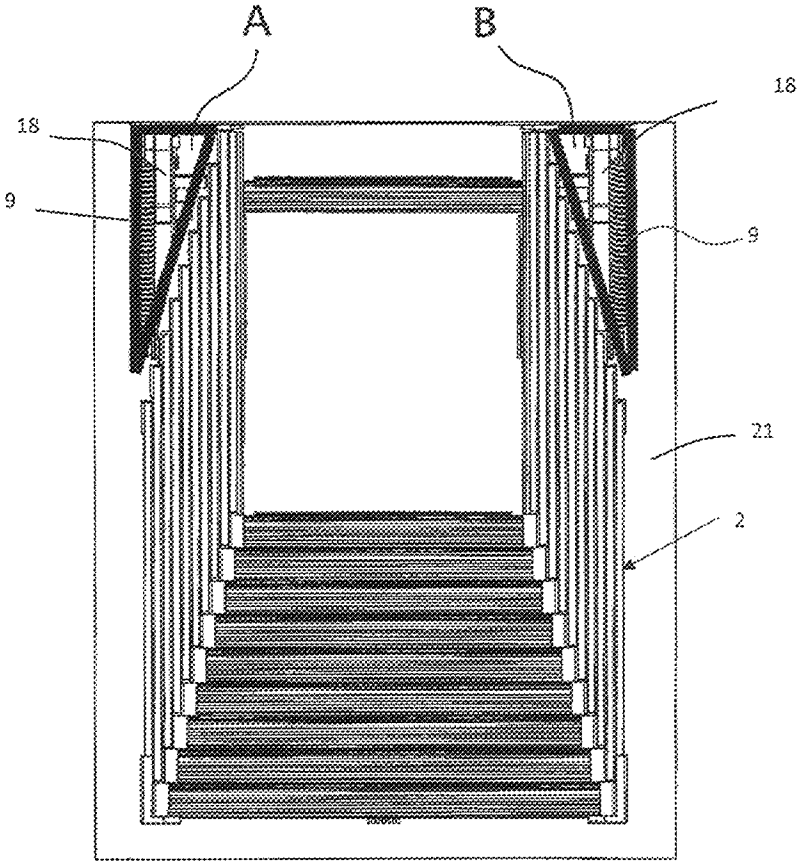
FIG. 17 shows a top view of the compact arrangement of the access device.

It is a notable feature for this configuration of telescopic ladder, as illustrated in FIG. 17 that the predominately triangular voids, A and B, within the three Cartesian coordinates of ladder volume provide working volumes into which the spring bias pivotal supporting frame can be configured as matching pairs. Configured as such the access device can be located compactly in access apertures marginally greater than the size of the access device needing only a small allowance for operating clearances. This enables the fully benefits of using a compact telescopic ladder to be fully utilised in such applications.

Extendable and retractable ladders suitable for these access devices often have primitive means such as fabric webbing and hook and tape fastening for retaining the nested or retracted ladder in the closed position. To provide an improved retaining means and to ensure the access device is correctly handled as it is lowered to the operating position there is in this invention the provision of third locking mechanism comprising a retaining strap 8 and a locking apparatus 7, such as catch 42 (FIGS. 18 to 20).

The strap 8 is fastened to the upper most ladder element 33*j*. The strap 8 extends along the back of the rungs 5*b* to 5*j*, on the retracted or nested sliding elements 33*b* to 33*j*, and is attached with a second end to the locking apparatus 7 on the reinforcement member 22. A locking plate 40 is fixed to the second end of strap 8, which is releasably received in catch 42 so as to prevent accidental opening of the nested ladder 2. The strap 8 continues beyond the locking plate 40 to form a pulling means to lower the spring biased pivotal access device assembly.

The locking apparatus 7 is so constructed that pushing the locking plate 40 into the catch 42 displaces the two spring biased latches 41*a* and 41*b*, and which then engage with two recesses on the locking plate 40. In this position the strap 8 is locked in position and the retracted or nested ladder 2 cannot extend. To unlock and release the strap 8, so as to extend the ladder 2, both latches 41*a* and 41*b*, have to be disengaged simultaneously to release the locking plate, 40. This third locking mechanism is an additional safety feature. The user of the access device lowers the assembly by pulling the end of the strap 8, and the ladder 2 remains secure in the nested format.

To release and extend the ladder, the user is obliged to place one hand either side of the ladder 2 on the outermost, first sliding element 33*a*, and using fingers and thumbs pull the release pins 39*a*, 39*b* outward against a spring bias (not shown) so allowing the locking plate 40 to disengage and the strap 8 to fall away from the first sliding element 33*a*. With the users two hands so positioned, the nested ladder is held correctly so allowing the ladder 2 to then be lowered and fully extended with one hand either side of the ladder 2.

An alternative spring biased cantilevered pivotal support for the access structure is shown in FIG. 21 where spring bias 43, is applied to a roller or stop 44 that locates in indents 46 in a circumferential arrangement providing location and support for the access structure. Profiles 45 are also used to provide resistance and assistance to the rotation of the pivot and access structure it supports.

A second embodiment of the present invention is shown in FIGS. 23 to 50, which illustrate an automatically extending ladder 102 of an access device 101, which can located in or on any floor, ceiling, wall, partition or interface to give access from one place to another. Parts of the second embodiment that are identical or have the same function as parts of the first embodiment, described in FIGS. 1 to 22, are referenced with the respective numbers of the first embodiment plus "100". These include locking members 104*a*, 104*g*, 104*h* and 104*j*, top rung 105*k* and top caps 131.

One common use is to provide access to a loft in a domestic dwelling but it is not limited to this one application. However the use of the access device is not restricted to said loft access, the ladder 102 could also be used as a tower, platform and leaning ladder.

The automatically extending ladder or stair 102, has a ladder or stair construction such as slidable elements 133*a* to 133*i* and a compact and mechanical drive and a pivotal supporting frame, and is configured to occupy the least space possible when not in use and to locate on one side of and within an access aperture 120, between two rooms, spaces or environments. The same automated access device 101, can also be arranged to open and lock a door, 200 closing and sealing the same aperture 120. For the purpose of this description the extending and retracting access structure is a ladder 102, but it can also be a stair.

The unlocking then opening of the door 200, and extending of the ladder 102, and the retracting of the ladder 102, then closing and locking of the door 200, can be initiated remotely so enabling the door 200, to be opened at an otherwise inaccessible place such as a ceiling and the operator in a remote safe location away from the device. Installing ladders in elevated, remote or inaccessible locations can be difficult so another feature of this invention is an improved installation process making it simpler, easier, quicker to effect and safer. To achieve this the invention embodies a pivotal support frame, having a second section 118 pivotally connected by a hinge 90 to a detachably attached mounting plate 110, to which are attached robust members 72 that hook and locate into matched sockets 73 on mounting plates 110 that are fixed into two corners either end of the surface 121 of the access aperture 120, to which the automatically extending and retracting ladder, 1, is mounted.

The mounting plates 110, as mirrored pairs are aligned to accept the two members 72, either or both of which can be adjusted in a lockable slide 75, to locate the automatically extending ladder 102, in an aperture 120 having the same or greater width of the access device. In this instance the adjustment is by sliding tubes adjusted and fastened in matched sleeves 77, with slots 76 for incremental adjustment by means such as nuts and bolts.

There are many forms of adjustment possible including the hooking members 72 being permanently fixed to the mounting enclosures 69 and being reduced in length to the required length, by cutting off excess material. FIGS. 44 and 45 show an alternative arrangement for detachably attached mounting means. The mounting plates 110, preferably as mirrored pairs, can provide additional functionality as structural strengthening and reinforcing plates at adjacent corners of the aperture 120. It is common for such apertures to be of unknown structural and integrity especially the joining interface between one structural member and another. The right angled and extended sides of the mounting plates 110, transfer part of the cantilevered loading on the support frame around to the sides of the aperture 120. Fastening members 111, such as screws, take shear loading such that the longer the sides of the mounting plates 110 are and the greater the number of fastening members 111 and the further they are from the hinge pivot, the less is the shear loading on these fastening members 111. Other forms of the mounting plate 110 can be configured to suit specific requirements for fastening the powered automatic access device 101 another example is illustrated in FIGS. 44 and 45. FIG. 44 also shows the handrail 59 that may be incorporated on one or both sides of the ladder 102.

Any fasteners retaining the mounting plates 110 have reduced axial loading along the length of the fastener and serve even more to strengthen the mounting aperture 120 and are less able to be unintentionally pulled out of their retaining media. Any form of mounting of the pivotal support frame can be used but the use of a mirrored pair of mounting plates 110 with matching sockets and adjustable mounting members 72, enables the automatically extendable ladder 1 to be mounted in an aperture of any width or length equal or greater than itself.

Another feature of this mounting means is the mounting plates 110 are relatively light in weight and easily handled and can be fixed independently of the ladder assembly 102, making it easier and safer than fixing the entire powered automatic access device 101 to the aperture 120, as one unitary bulky and heavy assembly.

With the mounting plates 110, securely and correctly positioned in to the corners of the access aperture 120, the ladder 102 can be accurately and safely lowered and hooked on to the mounting plates 110, with the members, 72 or 147, located in the sockets 73 or 149 on the mounting plates 110. Fine adjustment and alignment of the ladder assembly is effected by screws, 79, on or at the hooking interface. These or additional screws 78, can be fitted to stop the accidental removal of the ladder assembly 1, from the hooks.

Additionally the rapid fitting detachably attached hooking arrangement so described enables the ladder 102 to be removed and replaced at any time for whatever purpose, including maintenance without disturbing the mounting plates 110.

Another rapid fitting and adjustment means is shown in FIGS. 44 and 45, where mounting or anchor plates 110 are fixed to the adjacent corners of a common surface in the access aperture 120 each plate having a retaining means, such as socket 149 and locking screw 148. To fit the access device the mounting member 147, such as a hanging rail, on the static second section 118 of the support frame is hooked or located on the socket 149 and secured safely by tightening the locking screws 148 on to the mounting member 147.

With this device, the powered automatic access device 1 can be located at any interface where access up to or down from one or more levels or from one point to another are required. The ladder assembly 102 is typically of the smallest cubic format, such that it can be readily mounted and used in the smallest access aperture 120 and so constructed that without modification the same device can be used in the largest of apertures and even cantilever from one edge of such as a raised floor, ceiling or mounted on any surface to and from which access is required.

The powered automatic ladder access device, 1, embodies a pivotal support frame, which includes a second section 118 with mounting enclosures 69, which remain fixed, the second section 118 being pivotally connected to a first section 119 comprising a pivotal frame 65, to which the ladder 102 the powered drive assembly and the door 200, the door locking means 180, and other devices are located.

According to this second embodiment, the ladder 102 is a compact telescopic or multiple element extending and retracting ladder that is located on the frame 65, preferably in the smallest most compact nested form. The ladder 102, has multiple sliding elements 133*a* to 133*i* each of which can be extended or retracted, in any sequence, outwardly from one end of the frame 65 in a predominantly uniform linear plane in relation to the frame. The ladder stiles 106*a* to 106*i* are of similar or identical interlocking profiles joined by one or more rungs or steps 105*b* to 105*i*, where the stiles 106*a* to 106*i*, in each sliding element, 133*a* to 133*i* are offset and the length of the rung 105*b* to 105*i* is two offset lengths smaller or larger than the rung on the adjacent sliding elements.

There are many means by which the each sliding elements 133*a* to 133*i* can be extended but in this example it is by means of a rack and pinion mechanism. In other forms of the invention the extension and retraction of the ladder and the lowering and locking of the door and frame can be driven and controlled by other means including a reversible linear motion such as an actuator, a linear motor, a pneumatic cylinder, a hydraulic cylinder, a rotating crank and slide, or a cyclic loop such as a belt or chain, and by means of a wires and drums, in which one or two elements of the cycle are linear.

FIGS. 49 and 50 describe two means of providing the linear indexing of the ladder sliding elements. FIG. 49 shows progressive linear indexing and oscillation and FIG. 50 show how a cyclic mechanism such as a rotating wheel, chain or crank can be used to index and linearly extend and retract the ladder.

In this example of the invention it can be demonstrated that the linear extension of the ladder sliding elements 133*a* to 133*i* or the motor rotation, preferably in one continuous sequence, also provides the means to unlock the door 200, lower the door 200 and ladder assembly 102 to the desired positions, and on the reverse closing cycle to raise the door 200 and ladder assembly 102 and lock the door 200.

In this example of the powered automatic access device, 1, the motor and gear box drives a series of gear racks 160*a* to 160*i*, each attached to the lower edge of each moveable sliding stile element 133*a* to 133*i*, by means of spur gears 153*a* to 153*i*, one for each gear rack.

Each sliding element preferably has two gear racks 153*a* to 153*i* for which the gear tooth profiles are inline or matched on each pair of stiles 106*a* to 106*i*, on any one sliding element, 133*a* to 133*i*.

In the retracted nested form of the ladder assembly 102 there are two arrays of gear racks 160*a* to 160*i* either side of the ladder separated by the rungs 105*b* to 105*i* or reinforcement member 65 respectively, and each is a uniform offset from the adjacent gear rack. The offset is that of the nested pitch of the stiles. The gear racks 160*a* on the lowest and widest sliding element 133*a*, has two gear racks mating and biased on to spurs gears 153*a*, either end of a drive tube 150, the motor 155, gearbox and controls being positioned within the diameter and length of the drive tube 150.

The two matching spur gear clusters 151, located concentrically on the drive tube 150, are aligned with the two arrays of gear racks 160*a* to 160*i*, attached to the ladder stileson the ladder assembly 102. So in the nested retracted ladder assembly 102 the sliding elements, 133*a* to 133*i* and the gear racks 160*a* to 160*i*, are set apart a distance that is at a minimum the height of each rung. It is preferable but not essential that the offset of the rungs 105*b* to 105*i* and sliding elements is a distance that is one integer multiple of the gear pitch so that the gear teeth profiles align at the intersection of all sliding elements 133*a* to 133*i*.

FIGS. 46 and 47 show a means to ensure the driving spur gears 153*a* to 153*i*, forming a gear cluster 151 that remains in contact and meshed to the respective gear racks. The roller, 58, running on a surface on the pushrod, 86, prevents the gears from disengaging.

The offset of the gear teeth from the end of one first gear rack 153*a*, to the next or adjacent gear rack, ensures that in the nested retracted form of the ladder only the gear racks 153*a* on the first sliding element 133*a* are engaged through the mating spur gears of the drive tube 150 and motor gearbox unit.

So when the motor first rotates only the first sliding element 133*a*, is extended by connection to the first pair of spur gears, 153*a*, and gear racks, 160*a*, while the remainder of the nested retracted ladder assembly, 1, is retained using a locking mechanism including locking members to lock the retracted parts to the frame 65 or to the next adjacent sliding element as will be described with reference to FIG. 33.

As the first sliding element 133*a* reaches the end of its extended range, physical stops on the first sliding element, and the next sliding element make contact and the powered geared motor drive, through the spur gears, acting on the first sliding element pull this second sliding element 133*b* forward. Momentarily before, the second sliding element 133*b*, is pulled by the first sliding element 133*a*. Spring biased locking pins 170 (FIG. 33) of a second locking mechanism engage, safely locking these two sliding elements together. Simultaneously, or momentarily before, a locking member of the first locking mechanism holding the second sliding element 133*b*, to the third sliding element 133*c*, is released enabling the first and second sliding elements to extend (FIG. 33).

When the stops make contact with each other and the locking pins 170, engage, the gear profiles of the adjacent gear racks (such as the gear racks of the first and second slidable element), are in alignment and overlap by one or more gear teeth or pitches so that after a short distance, preferably one or more gear pitch lengths, the second pair of gear racks 160*b*, is then pulled on to the next set of spur gears, 153*b*, on the drive tube 150, and the drive from the motor through the drive tube 150 to the spur gears and the gear racks transfers wholly to the second pair of gear racks 160*b*, and sliding element 133*b*. The second sliding element 133*b* then extends automatically engaging the next gear rack pair, releasing the latch or lock member 104*b* of the first locking mechanism and third sliding element 133*c*, and simultaneously locking the second and third sliding elements, 133*b* and 133*c*, together.

This sequence continues until all sliding elements 133*a* to 133*i* are extended from the last non-slidable element 133*j*, which remains anchored to first section 119 of the frame. The motor, is pre-set to automatically switch off after a pre-determined number of revolutions and to coincide with the instance where the penultimate sliding element extends so the stops make contact with the last, upper most non-slidable element 133*j*.

The ladder 102, in this fully extended format, has the all sliding elements 133*a* to 133*i* locked and the only the spur gears 153*i* and gear racks 160*i*, on the penultimate and uppermost sliding element 133*i*, are meshed.

To retract the ladder 102 the motor 155 is switched on and turns in the reverse rotation, and the upper most sliding element, 133*i* is pushed by the already meshed spur gears, 153*i* and gear racks 160*i* back further onto the top ladder element, the non-slidable element 133*j*, that is fixed to first part 119 of the pivotable support frame. As this retracting sliding element 133*i* reaches the stop on the upper most element, the locking pins 170 locking the next two sliding elements 133*i* and 133*h*, are released and the locking member 104*i* of the first locking mechanism engages, holding the upper most (last) sliding element 133*i*, in the fully retracted position. Simultaneously during this same transition the overlapping and synchronised gear pitches on the next two sets of gear racks 160*h*, are pulled on to their driving spur gears, 153*h*, on the drive tube 151. The engagement of this next gear set enables the power drive to pull up the next sliding element and this procedure is repeated until all ladder sliding elements are fully retracted and retained by the latches or locks.

On the final positioning of the lowest sliding element 133*a*, the limiting switches 152, on the motor are adjusted to switch the motor off. The lowest sliding element 133*a* can be held by the resistance of the motor drive assembly or independently latched or locked, by the first and/or third locking mechanism, once retracted.

The extending and retracting of the ladder 102 has been described and it has also been presented that in this invention it is preferable that the full opening cycle, incorporating the unlocking of the door, 200 the lowering of the door 200 and extension of the ladder 102 is enacted and managed by a timed sequence of the motor 155, and the entire closing cycle achieved by reversal of the motor and operating cycle.

So it is shown that the extension of the ladder by the motor drive can be used sequentially or concurrently to unlock the door 200, and lower the automatic access device 1, and door 200, to the preferred operating angle and in the reverse retracting cycle, retract the ladder 102 lift the automatic ladder access device 1, close and lock the door 200.

In FIG. 39, is shown a linkage for a door locking means 180 to a reaction pad, 181, that is biased against a feature on the first sliding element 133*a*, such as the top cap 132. When the first sliding element 133*a* starts to extend, the reaction pad 181 is released and the door lock 185 is opened. Reaction pad 181 and door lock are connected by lock element 183, which pivots around point 182. In the reverse retracting cycle the same sliding element 133*a*, hits the pad, 181, and pushes the door lock 185 to the closed position. In another configuration the door 200 can be mechanically released but allowed to self-latch and lock against a spring bias 184.

After the door lock 185, has been released the end of the first stiles 106*a*, holding a sliding block 54 to which a supporting wire 52 is attached, moves in the slot, 53, acting as a guide for the sliding block 54 so increasing the wire length between the pulley, 50, and wire anchor bracket, 51, so allowing the door 200 and pivotable first section 119 of the frame assembly, to open to the working angle for the ladder. In some configurations of the flexible supports, it may be advantageous to include an extendible spring 57 between the end of the wire 52 and the wire anchor bracket 51. There has to be adequate clearance, between the access aperture 120, and leading edge of the ladder, 102, for the initial extended length of the sliding elements to allow the sliding block, 54, to move and so to extend the wire, 52, and lower the ladder, 102, beneath the ceiling surface before extending further and fully. In a another instance of the powered automatic access device, 1, the first sliding element 133*a* can be replaced by a pair of shortened sliding plates, 83 with gear racks 81, arranged so that they can extend and open the pivotal supporting frame, and nested retracted ladder 102, before any of the ladder sliding elements 133*a* to 133*i*, extend.

FIG. 30, shows a sliding plate 83, a gear rack 81, and an extended push rod 82 that act collectively as an alternative to the sliding element 133*a*. The plate, 83, can extend so allowing the sliding block, 54 to slide in the slot, 53, so extending the effective length of the supporting wire 52 and lower the first section 119 of the frame together with frame housing 65 to the desired angle before the first working sliding element 133*a* of the ladder 102 is released.

FIG. 48 shows adjustment roller 58 for the supporting wire length and angle of the pivoting frame. The linear movement of the any ladder sliding elements 133*a* to 133*i*, ladder part or any part or device added to the ladder or any part effected by the movement (directly or indirectly linked) or sensing device, can be used to control or switch or manage other devices such as lights, security devices etc.

In an example of the powered automatic access device, 1, as is fitted to an aperture 120 in a ceiling to provide access to a loft or attic, the powered automatic access device, 1, is attached to the loft access aperture 120 such that the compact nested ladder assembly 102 and housing 65 of the second section 119 onto which the ladder assembly is mounted, preferably lie horizontally, parallel to, and within the depth of the ceiling or loft floor.

The powered automatic access device, 1, and door, 200 are held in this closed and parked location in the ceiling by supporting wires, 52, fixed between moving and fixed parts, that is first and second section 119, 118 of the pivotable support frame. The pivotable support frame, is retained by multi-core flexible steel ropes or wires, 52, tied at one end by means of a swaged loop, 56, on to the wire anchor bracket, 51, fixed to the mounting enclosure, 69, and so to the mounting plate 110. The flexible supporting wire, 52, extends to a freely rotating pulley, 50, mounted at the other end of the supporting frame housing 65, and then continues in the opposite direction to the pivoted end of the frame where it is retained onto a sliding block, 54, the travel of which is controlled by an extended opening or slot, 53, in the side plates of the housing 65, that so forms a linear slide or guide for the sliding block, 54.

The wire, 52, also provides the means of controlling the opening and lowering of the automatic ladder access device, 1, and the door 200 when fitted. So when the sliding block 54 moves forward or backwards in the slot or slide opening 53, the length of the wire 52 between the pulley 50 and the fixed bracket 51 increases and decreases respectively allowing the powered automatic ladder access device, 1 to pivot either way about the hinge pivot 90 from the horizontal to near vertical position and back.

In one example of this invention it is preferable to have a single power source, such as an electric motor 155, and when appropriate assisted by gravitational forces provides the motivating forces for unlocking the door 200 lowering the door 200 and ladder 102 extending the ladder 102 retracting the ladder, 102 lifting the ladder and door, then closing and locking the door, 200. In this example it is also preferable to have the opening and extension of the ladder controlled at a continuous fixed speed, and fixed number of rotations of the motor, 155, so the motor can be switch on directly or remotely by a switching means and automatically switched off, by arrangement of adjustable limit switches or electronic controls, 152, within the motor and gearbox assembly so stopping the motor after a set number of turns or part turns or a set duration. Switching on the motor again reverses the motor direction until the powered automatic access device, 1, and door, 200 returns and locks and the motor automatically switches off by means of a second previously adjusted limit switch or timer within the motor and gearbox assembly.

In other forms of this invention, the ladder may be a telescopic ladder 102 with two overlapping sets of concentric hollow stile elements in which the format of the overlapping concentrically or axially aligned nested hollow elements prohibit the attachment of gear racks. In this instant the gear racks can be attached to the rungs steps or structural members of each sliding element.

Alternatively each sliding element can be extended and retracted using an oscillating device, that attaches preferably to the rung on to the first sliding element then detaches and returns further back each cycle to attach to the next rung in the sequence and extend the next sliding element returning further back each time to connect to and extend all sliding elements the latch and locking being the same or similar to the means on the example of the gear rack and spur gear mechanism. The driving means can be of any cyclic, oscillating or reciprocating mechanism including an indexed reciprocating crank and linear guide, a linear motor, a linear actuator, a pneumatic cylinder, a hydraulic cylinder, a rotating cyclic belt, chain or rope drive, even a gravity drive with retrieving cable on a wire drum.

The powered automatic opening and lower of the door 200 and ladder 102 is a complex task requiring the operation of many parts and assemblies. The task of opening the ladder and door and the reverse task of retracting the ladder and door has to be completed safely, accurately and efficiently. One example of the invention has been described but there are parts, assemblies and feature on this invention that can be incorporated in other devices.

On the extended ladder, the overlapping elements are locked together preferably with a spring biased locking pin 170, located in a stile 106*a* to 106*i* at the ends of the ladder rung 105*b* to 105*i*. Other arrangement of the locking pin and spring bias can be used and the can also be located in or on, or between the stiles.

The spring biased locking pins 170, automatically engage in matched holes or receiving means across adjacent sliding elements 133*a* to 133*i*. To unlock or release the pins 170 there are many devices that can be used such as cams and rotating levers. It is preferable that the sliding elements 133*a* to 133*i*, in the retracted nested ladder assembly, 102 are held stationary using a locking member 104, such as latches, so that when the slide axis or plane is near vertical the ladder 102 does not extend under its own weight. The latches or locks of the locking member 104 are fixed on the sliding element adjacent to the next sliding element or alternatively to a common mounting frame. The locking members 104, are typically sequenced such that the ladder 102 can be extended from the bottom sliding element 133*a* upwards or the top fixed sliding element 133*i* down but not restricted to such.

In the example of the powered automatic access device, 1, described, it has rungs 105, stiles 106 and gear racks 160, as well as both locking means 170 for the ladder extended and locking members 104 for the ladder retracted in the most compact format. The locking members can be of any type or location and the latching or locking means can be between two sliding elements 133*a* to 133*i*, or a sliding element 133*a* to 133*i* and the housing 65 of the support frame. The sequence and timing of the locking and latching means can be adjusted.

The remote automatic opening and closing of the door, 200 and ladder, 102 the use and safety of the powered automatic access device is dependent on this sequence of locking and unlocking means. The motor or drive mechanism can be used to lock or restrain the sliding elements at either end of the ladder.

In an example of the invention, the ladder, 102 is made up of sliding elements 133*a* to 133*i*, where the stiles 106*a* to 106*i*, are the same or of similar cross element and are offset and interlocked with the adjacent stiles 106*a* to 106*i*. There are other forms of telescopic ladder where the sliding ladder elements have stiles of concentric matched telescopic sections. Ladders of both types can be used in the automatic ladder access device, 1 indeed any multiple sliding element ladders can be incorporated in this invention. It is a feature of this invention that the ladder, 102 or stair can be used to span a range of heights between two floors or stages.

The ladder length can be increased by adding additional sliding elements. For any fixed ladder length it is advantageous to be able to use the one fixed length for a range of different ceiling heights. It is permissible within statutory government legislation to vary the angle of use of the ladder. So in an example of this invention there is an adjustable stop 190 consisting of a threaded rod 193 and an adjustment knob 191, 192 so arranged in the slots or slides 53 that it restricts the travel of the sliding block 54, to which to lower end of the supporting wire 52 is attached. The adjustable knob, 61 acts as a stop for the sliding block, 54 so enabling the angle of the ladder to be predetermined for any desire angle or ceiling height. On the initial installation of the automatic ladder access device, 1, in a loft access aperture 120, the adjustment knob 191, 192 is positioned so that the ladder 102 and door 200 open and lower and the ladder 102 extends and the angle is such that the end of the ladder 102 remains suspended off the floor to which it is to rest on. At this point the adjustment knob 191, 192 can be rotated and positioned so as to extend the effective suspended length of the supporting wires 52 such that the first section 119 of the support frame rotates further until the roller 62 on the end of the lowest extended slide 133*a* makes contact with the floor and starts taking the weight of the ladder 102. The roller 62 allows the ladder angle or length to increase and avoid damage to the floor or ladder assembly.

An example of a door lock, and release means has been described but any type or form of lock or latch can be fitted to the door, 200 or frame and automatically released by the motor 155 by rotating spur gears 151 or by the gear racks 160*a* to 160*i*, or by part of a sliding ladder element or by a device added to a sliding ladder element or alternatively by some separate or independent means.

It is a feature of this invention that the powered automatic ladder access device 1, includes a pivotal support frame with a housing 65 to which can be mounted a door or panel 200 of any material or type and that the mounting provides adjustment and alignment in the access aperture 120. The door, 200 is screwed and secured onto the housing 65 of the support frame in several places. In some examples a door is not fitted.

It may be preferable in this invention to provide adjustment for the depth and orientation of the door or panel, 200 when mounted to the housing 65. FIG. 43 shows one example where the housing 65 of the pivotal frame is attached to a hinge member 91, with slots which allow adjustment for a range of door thicknesses.

An example of an improved installation means for mounting the powered automatic access device 1 has been described which uses two corner reinforcing mounting plates 110, each with a socket 73 or 149 that can be mounted in an access aperture 120 of any practical width. The mounting plates 110 are screwed or bolted to the sides of the aperture 120 acting to provide two hooking locations for the automatic ladder access device, 1, and additionally acting to strengthen and stiffen the access aperture 120. Two adjustable members, 72, clamped to the second section 118 of the support frame allow the complete powered automatic access device, 1, to be lifted and dropped into sockets 73, one on each mounting plate 110. The socket 73 allows the adjustable members 75, to be held in place with a screw or pin to stop the automatic ladder access device 1 being accidentally lifted out. The socket 73 can also have adjustment means to align the frame, ladder, 102 and door 200 in the aperture 120. In other instances of the invention it can be preferable to have some alternative means of attachment and adjustment to the aperture 120.

A drive means has been described and is illustrated in FIGS. 27 and 28, where there is a tubular motor assembly containing the motor 155, the gearbox, limit switches 152, the control means and bearings within one cylindrical tubular arrangement. At one end is located the drive output shaft, drive bush 156 and bearing means and at the other the attachment means to fix the motor assembly to the housing 65 of the frame and to prevent rotation. At this same end are located adjustment screws 152 to limit the number of revolutions of the motor and start and finishing positions. These adjustments 152 are preferably pre-set but in other applications of the invention it may be advantageous to provide access to adjust these.

Around the diameter and length of the tubular motor, is located a drive tube 150, attached to the motor drive shaft by the drive bush 156, which also provides a bearing surface when rotating in the bearing journal, on one side plate of the frame. The other end of the drive tube 150 is located on a slave bearing that rotates around the tubular motor body. The drive tube 150 has a uniform profile with keying means or castellation to locate and drive the spur gears 153*a* to 153*i*, which can be constructed individually as extruded, sintered, cast, pressed or plastic moulded parts. Each gear is aligned and meshes with each of the gear racks 160*a* to 160*i*, on all the sliding elements 133*a* to 133*i*. In an alternative form the gears may be machined as two sets or clusters each from an extruded section so providing the gear and keying profiles and individually mating gears.

The supporting frame assembly consist of a hinge, 90, connecting a first fixed section 119 to a second pivotable section 118. The hinge 90, is preferably a continuous hinge across the width of the frame. The first section 119 of the frame, which is connected to the moving part of the hinge has a housing 65 with two side plates, a front tie, 66, a middle tie, 67, and brackets, 68, for mounting the ladder assembly 102 to the frame.

The mounting plate 110, joined to the static part of the hinge has two mounting enclosures, 69, onto which are connected the wire anchor brackets, 51, and members 72 that are adjusted and clamped to the inner width, that is the length between the mounting plates 110 in the access aperture 120 and of a profile to match the sockets 73, on those plates.

The motor assembly 155, is fixed at the forward end of the housing 65, adjacent to the front tie, 66, it being fastened on one side plate of the housing 65 and free to rotate in a bearing journal 64, on the opposite side plate. The bearing journal 64 can be a pressed feature in the side plate but is not limited to such. The front tie, 66, also forms a safety cover to restrict access to the spur gears 153*a* to 153*i*, and drive unit.

One end of the ladder 102 can be pivotally fixed to the two brackets 68 on the second part 118 of the support frame and the other end rests on the spur gears 153*a* to 153*i*, of the drive assembly so the gear racks 160*a* to 160*i* align and mesh with their respective spur gears. The mass of the ladder assembly assists in keeping the gear racks 160*a* to 160*i* in mesh with the spur gears 153*a* to 153*i*, and springs connect the fixed top ladder element, to the middle tie, 67, so that a spring bias can be put on the interface between the spur gears and gear racks to further ensure that the gears remain constantly in mesh. The spring bias can also be provided by torsional bias in the ladder mounting bracket, 68.

It is a notable feature of this invention that the gear racks 160*a* to 160*i* have gear rack roots 161*a* to 161*h* and control members 166*a* to 166*h*, as well as supporting sides 162*a* to 162*h*, which substantially increase the strength and maximum loading on the gears and the outer edges of these supporting sides 162 mate with annular surfaces, either side of each spur gear 153*a* to 153*i*, so the gears can be spaced and meshed correctly without excessive wear on the gear teeth. The gear racks can be made as a homogenous structure from a single material and cast or injection moulded in a single engineering material or alternatively made of component parts and assembled.

In other instances of the invention it is preferable to replace the springs with a fixed rigid constraint creating a fixed alignment between spur gears 153*a* to 153*i*, and gear racks 160*a* to 160*i*.

The supporting frame embodies a pair of mechanisms that enable movement of the ladder assembly from the horizontal position in the access aperture 120 to the predominantly vertical position at which the ladder is extended, locked and used. The adjustment mechanisms use supporting wires 52 and pulley 50 but equally they can be substituted by chains and sprockets or toothed belts and toothed pulleys. The upper most end of each of the supporting wires 52 of equal length is pivotally attached to the respective wire anchor plates 51 on the mounting enclosures 69. The supporting wires 52 extend forward and are wrapped around the pulleys 50 that freely rotate on axles fixed to the outboard end of the side plates of the housing 65, then extend backward and are clamped to sliding blocks 54 each of which locates in the extended slots 53 acting as guides on the respective side plates of the housing 65.

With the ladder 102 and frame in the nested retracted position in the access aperture 120, the sliding blocks 54, are restrained from moving by the top ends of the stiles 106*a*, on the lowest or first sliding element 133*a*. In this format the sliding blocks 54 are at the end of the slots nearest the hinge pivot. It is a preferred feature of this invention that the linear displacement of the sliding elements, forming the access device, provide the driving means for the unlocking and locking of the door, the opening and closing of the door and access device and the extending and retraction of the access structure. When the ladder 102 starts to extend the first sliding element 133*a* moves forward, or in other instances a pre-arranged slide 83, and the wire tension keeps the sliding blocks 54 in contact with the end of the stiles 106*a* or slides 83, such that as the first sliding element 133*a* or alternatively the slide 83 extends the sliding blocks 54 to move away from the hinge pivots. The effective length of the wire 52 between the pulley 50 and the wire anchor plate 51 increases and the frame is allowed to drop and rotate under its own weight. The sliding blocks 54 continue until they stop at the other end of the slot 53 leaving the frame and ladder at a predetermined angle.

The stop can be the end of the slot 53 but in many instances it is preferable to have an adjustable stop 190, at the end of the slot 53 so that the resting angle of the ladder can be adjusted. This is beneficial when the one fixed length of ladder is to be used for alternative heights between floor levels or the ladder must be at a set angle.

The wire anchor plates 51 are fixed to the two mounting enclosures 69, on the fastening members 11. The mounting enclosures 69 provide location and storage for lighting, controls and power supplies. The bottom edges of the mounting enclosures, 69, provide stops for the hinge 90 when the ladder is in the horizontal closed position. In this example the hinge is freely rotating. In alternative examples of the invention the hinge may embody torsional springs to counterbalance all or part of the cantilever weight or the automatic ladder access device 1.

Further embodiments of the present invention are described by the clauses below.

Clauses

1. A cantilever mounted access device comprising; an extendable and retractable access structure, retaining means for the access structure, spring biased cantilever supporting pivots, and mounting apparatus in which the access structure has a plurality of extendable and retractable sliding elements, that when the elements are released from the retaining means and extended they automatically lock to the adjacent sliding element, and after the outermost sliding element is unlocked and retracted automatically unlocking the adjacent sliding element until all sliding elements are retracted, and the pivotal parts of the spring biased pivots are attached to the first element of the access structure, the other extending and retracting sliding elements of the access structure supported sequentially by the next sliding element from the further most extendable and retractable sliding element back to the first element, and a spring bias acting between the fixed part and the pivotal part of the spring biased pivot so that the access structure is supported from the first fixed element as a cantilevered structure and can be mounted and adjusted and held in any chosen position and the spring bias used in transition to resist or assist movement of the access structure.

2. An access device in Clause 1, where the access structure is; a ladder; steps; or stairs.

3. An access device as in Clauses 1 and 2 where the retracted access structure is retained by a strap fixed to the sliding elements either end of the access structure and locked and released by means of detachably attached locking apparatus.

4. An access device as Clause 1 where the retaining device for the retracted access structure is released by simultaneously releasing two independent devices operated by each hand at or near to either side and base of the access structure and positioned such that the two hands support the weight of the access structure on the outer most or lowest sliding element allowing the user to extend the access structure while both hands support the weight of the access structure.

5. An access device as in Clause 1 where the spring bias of the retaining strap or the retaining strap mounting provides the retaining means for the detachably attached locking apparatus and retracted access structure.

6. An access device as in Clauses 1 to 4 where the retracted access structure is retained exclusively by the strap and retaining device.

7. An access device with detachably attached adjustable mounting apparatus, as in Clauses 1 and 2, where a mounting plate or pair of mounting plates, each with a plurality of holes with which to fasten the plates to a structure, also function to improve the mechanical and geometrical integrity of the structure to which it is mounted.

8. Mounting apparatus, as in Clause 7, with detachably attached adjustable mounting where a mounting plate or pair of mounting plates each with a plurality of holes with which to fasten the plates to a structure have folded ends enabling the mounting plate or plates to be fastened to two adjacent surfaces of an access aperture or structure to further improve the mechanical and geometrical integrity of the structure to which it is mounted.

9. Mounting apparatus, as in Clauses 1 and 2, where the mounting apparatus is detachably attached to the access structure and supporting means so enabling the retained mounting means, that has receiving means for the detachably attached access structure and supporting means, to be independently fixed to the holding surface or structure prior to the detachably attached access structure and supporting means being located into the receiving means and secured.

10. An access device with one or more spring biased pivots as in Clause 1 in which the over centre spring bias on the pivot is provided by the extension of a spring either side of the pivotal centre such that the access device is biased from an initial retained position through an over centre neutral position to another spring biased position where the access structure can be released, extended and used.

11. An access device and mounting apparatus, as in Clause 1 and 2, in which the spring bias and angular displacement of the access structure is provided by the spring bias on one or more rollers or stops onto indents, cams or features on a circumferential or defined profile about the axis of the spring biased pivot such that the access structure can be located in any stored position or operating position and a resistive or assistive spring bias applied during the transition to and from these positions.

12. A spring biased pivotal mounting means as in Clauses 1, 2, 10 and 11, where the pivoting means is a linkage arrangement with a plurality of pivots.

13. An access device, as in Clauses 1 and 2, where the cantilevered support for the first element of the access structure to a supporting structure or surface is in one predetermined position.

14. An access device, as in Clause 1 and 2, where the detachably attached mountings provide positional adjustment of the access structure.

15. An access device, as in Clause 1 and 2, that can be located within and mounted on one or more surfaces of the access aperture through which the access structure provides access.

16. An access device, in Clauses 1 and 2, where the mounting apparatus, retracted access structure, and cantilever supporting spring biased pivoting means are configured within the principal three dimensional Cartesian coordinate boundaries of the access device enabling compact fitting into an aperture.

17. An access device in Clauses 1 and 2, where the access structure comprises telescopic extendable sliding elements comprising identical or similar sliding profiles which are offset, adjacent and interlock to the sliding profiles in the adjacent sliding elements.

18. An access device, in Clauses 1 and 2, where the access structure comprises telescopic extendable and retractable sliding elements that are concentric tubes of any profile with parallel sliding axes.

19. An access device, in Clauses 1 and 2, which have extendable retractable elements that are of pivotal parallelogram construction.

20. An access device, as in Clauses 1 and 2, where there is a detachably attached mounting between the first element of the access structure and the pivotal part on the cantilever supporting spring biased pivot.

21. A powered automatic access device comprising; an extendable access structure, a pivotal frame assembly, a powered drive, and mounting apparatus, that provides access from one place to another, in which there is an extendable and retractable access structure with a plurality of interconnected sliding elements, each providing one or more stepping means, that extends, partially or fully, from a compact, retracted, nested and secured arrangement, to provide access and so arranged that the powered automatic access device and door, closing the aperture in which the powered automatic access device is attached by means of detachably attached, adjustable, mechanically, geometrically and structurally enhancing mounting apparatus, can be unlocked, the pivotal frame supporting the access structure opened, the sliding elements unlocked, extended, and locked by the powered drive means sequentially transferring drive to each adjacent sliding element and in the reverse powered drive cycle the sliding elements unlocked, retracted, and locked, the powered automatic access device and door returned and locked in the aperture, all enabled by a powered drive means that extends or retracts each sliding element, to extend and retract the access structure, the linear motion of which drives the unlocking and locking means for the door, the opening and returning of the door, and the extending and retracting of the access structure.

22. An alternative embodiment of a powered automatic access device that provides access from one place to another, comprising an extendable and retractable access structure with a plurality of interconnected sliding elements, each providing one or more stepping means, that can be extended from a compact retracted nested and secured arrangement to provide access and so arranged that the powered automatic access device whether fully or partially retracted or extended is a freely portable unit for which the sliding elements progressively unlock, extend, and lock the powered drive means transferring the drive to each adjacent sliding element and in the reverse powered cycle the sliding elements unlocked, retracted, and locked by the powered drive means transferring the drive to each adjacent sliding element as the access structure is retracted.

23. A powered automatic access device, as in Clause 21 and 22, pivotally fixed at one end.

24. A powered automatic access device, as in Clauses 21 and 22, where the extendable and retractable structure is of any construction.

25. A powered automatic access device, as in Clause 22, that is a configured as a ladder, steps, or stairs.

26. A powered automatic access device, as in Clause 22, with a plurality of extendable and retractable structures connected to provide access to and from an elevated platform.

27. A powered automatic access device, in Clauses 21 and 22, where the extendable and retractable structure comprises a series of interlocked sliding elements, having overlapping slides of the same or similar section profile that are interlocked, offset and adjacent to the next slide.

28. A powered automatic access device, in Clauses 21 and 22, where the extendable and retractable structure comprises a series of interlocked, overlapping sliding elements, of concentrically aligned hollow elements of incrementally larger or smaller matched section profiles.

29. An extendable and retractable structure, as in Clauses 21 and 22, where the retracted sliding elements are locked to the adjacent sliding element by automatically engaging locking devices.

30. An extendable and retractable structure, as in Clauses 21 and 22, where the retracted sliding elements are locked to a supporting frame by automatically engaging locking devices.

31. An access device as in Clause 21 having apparatus to unlock, open and position the door and access structure before the access structure is extended and in the reverse cycle is so arranged that the sliding elements are retracted before the door and access device are closed and locked.

32. Apparatus as in Clause 31 which is driven by the same power source as that driving the sliding elements.

33. An access device as in Clause 21 mounted to an unrestricted aperture or surface.

34. An access device in Clauses 21 and 22 where the powered drive means comprises a series of gears and gear racks, the gears arranged concentrically around a unitary motor, gearbox and control unit and the gears aligned with respective gear racks on each sliding element or apparatus for door opening and closing and door unlocking and locking.

35. An access device as in Clauses 21 and 22 where the powered drive comprises a reciprocating engaging and disengaging linear drive.

36. An access device as in Clauses 21 and 22 where the powered drive comprises a linear part of a cyclic drive such as a moving belt or chain.

37. An access device as in Clauses 21 and 22 where the single unitary power source is replaced by a plurality of independent powered drives.

38. An access device as in Clause 22 where the access device is driven by an independent motor or power unit applied to the access device only to unlock, extend, lock or unlock, retract, and lock, the access structure.

39. An independent rechargeable power source and power device wholly retained as the drive for the access device.

40. An access device as in Clauses 21 and 22 where the access device, drives, functions and controls are remotely operated by transmittable signals from independent transmitting and receiving devices.

41. A drive means as in Clause 36 where the driving gears and the driven gear racks are held in mesh by a spring bias.

42. A drive means as in Clause 36 where the driving gears and the driven gear racks are held in mesh by fixed retaining means.

43. A drive means as in Clauses 36, 41 and 42 where the gear rack and slide is a unitary homogenous part of the same material.

44. A drive means in Clauses 36, 41, and 42 where the cluster of gears is formed from one unitary homogenous part of the same material the gear teeth profile formed around an extruded profile and the individual gears created by machining circumferential slots at fixed displacements along the axis of the profile.

45. Mounting apparatus as in Clause 21 where there is a pair of plates, each with a similar angled fold, that are attached into adjacent corners either end of a common surface of an aperture and each plate with hooking and detachably attached and adjustable fixing means to receive and retain the access device in a range of lengths for the common surface, the plates providing mechanical, structural, and geometric enhancement for the mounting and aperture structure.

46. The mounting apparatus as in Clause 45 arranged on a pair of flat plates.

47. The mounting apparatus as in Clause 45 arranged on a single plate.

48. A detachably attached pivotal frame assembly as in Clause 21 comprising a mounting frame, a support frame holding the access structure, opening and closing apparatus, and a powered drive, in which the extension and retraction of sliding elements, locks and unlocks, opens and shuts, and adjusts the support frame by means of supports and sliding mountings.

49. A detachably attached pivotal frame assembly as in Clauses 21 to 48 where the pivot has torsional spring bias means to reduce the loading on the open and closing supports.

50. A powered drive comprising a tubular motor, gearbox and control assembly, encased by a concentric drive tube on which the gears are located and fixed.

51. A powered automatic access device as in Clauses 21 and 22 where a plurality of functions are driven by the linear displacement of the sliding elements on the access structure.

In alternative embodiments an access structure such as a ladder with stairs or steps is provided, for gaining access from one place to another, that is retained, as a cantilever supported retracted compact assembly, to one or more sides of an access aperture and wholly located within the aperture, so consuming little or no space outside of such aperture and so retaining full use of the space above and below which the access aperture is located.

A typical application, but not limited to such, is a ladder to gain access to or from a loft or attic in a house. In existing examples of loft ladders the ladder and attachments are located in part or whole outside of the aperture so consuming useful space, creating obstacles and restrictions to access, and they are often larger than the access aperture requiring enlargement of the apertures and the ladders are often complex to fit and use.

In one embodiment there is a telescopic ladder which is attached within and on one side the access aperture by means of spring biased pivots as a cantilever supported extendable and retractable access structure with the pivotal part of the spring biased pivot attached to the ends or sides of the stiles, rungs or structural members of the uppermost first fixed non sliding element of the ladder or steps and the fixed part of the spring biased pivot being attached to one or more sides of the access aperture by mounting apparatus. In other configurations of the fixed part of the spring biased pivots are retained to more than one side of the access aperture using a plurality of detachably attached mounting means that enables a more versatile, easier, safer and quicker way of installing and adjusting the access structure within the aperture.

So in an example the access device comprises, the ladder assembly, a mounting plate with detachably attached hooking elements, cantilever supporting spring biased pivots with devices to locate securely in the hooking means, spring bias means, and a retaining means to secure and release the retracted ladder and then lower the ladder to its operational position before it is then fully extended.

Describing the installation of one embodiment of the access device in the access aperture demonstrates the construction and function of the assembly, subassemblies and key component parts. Firstly a mounting plate, typically but not exclusively a single plate extending across part or the whole of the width of the ladder assembly, is independently fixed, typically mounted centrally, on to one side of the access aperture to the loft. The position of the mounting plate is such as to allow a door to be independently fitted and closed below the ladder assembly.

With the mounting plate fixed to the access aperture the ladder and spring biased pivot assembly is then located and secured on to detachably attached hooking or retaining features on the mounting plate, then adjusted, locating the assembly in its stored location as an extendable and retractable ladder ready to provide access to and from such place as a loft. It is advantageous to incorporate a safety device to avoid accidental displacement of the access structure and supporting means from the fixed part of the detachably attached mounting.

It is a notable feature of this that when fitting the ladder assembly to the aperture it is beneficial the installer does not have to handle the entire weight of the ladder and mounting assembly when aligning and fastening the ladder to the access aperture. With the detachably attached mounting arrangement the installer has only to handle the weight of the mounting plate, circa 1 kg, during the alignment and attachment to the access aperture rather than the entire weight of the ladder assembly, circa 12 kg. Consequently it is much easier and safer, at this critical point of the installation, to position, align and secure the mounting for reliable and safe use of the installed loft ladder.

The detachably attached mounting arrangement and use of independently fitted mounting plates enables the rapid mounting and also dismounting of the ladder assembly should greater access be required through the aperture or the ladder removed for maintenance.

The ladder assembly typically has two spring biased pivots fixed to either side of the fixed first element of the ladder locating onto two matched hooking features on the mounting plate. The static fixed part of the spring biased pivots are mounted to the hooking features using such as a bar or tube but not limited to such. These fixed static pivot parts when attached and secured to the mounting plate embody other functions such as means to adjust the height and angle of the ladder assembly in the aperture and when extended.

The pivotal part of the spring biased pivots are attached to the uppermost cantilever supported element of the telescopic ladder or extendable ladder such that the entire ladder is cantilevered through the spring biased pivots, the fixed and pivotal hinge elements being spring biased such that the closed retracted ladder assembly is held, in this instance, in a nominally horizontal cantilevered orientation by the spring bias force on each pivot against a stop which may be adjustable.

The pivots and mounting apparatus can also embody features for adjusting the ladder height, ladder angle and the hinge angle. The spring bias may be fixed or variable and provide other functions such as indexing, resistance to rotation and supporting means.

On some configurations the springs fitted to the pivots are offset from the neutral axis and apply a torsional load along the pivot axis so it advantageous to fit restraining devices between the fixed and moving parts of the pivot assembly to reduce distortion and eliminate catastrophic failure.

The ladder and supporting pivot assemblies can be connected and removed as one entity from the hooks on the mounting plate without displacing or extending the springs so eliminating the danger of the installer being obliged to fitting these very strong springs as is the case on many other loft ladder assemblies in the market. In other embodiments the detachably attached connection or mounting can be between the pivot assembly and the upper most or first element of the ladder such that the ladder can be easily removed and the mounting and pivoting means retained in the access aperture.

The geometry and mechanical loading on the pivots is such that with the ladder in the closed position the pivot can be located to reduce the spring bias required and to allow the spring axis to go over centre of the pivot axis such that once the ladder assembly is lowered from the stored position in the loft access aperture and the spring passes "over centre" the pivots open typically toward and on to a fixed or adjustable stop defining the working position of the ladder.

Other configurations of the spring bias pivotal cantilevered mounting can be used to locate, and control the ladder to and from the stored location and in designated working positions. For instance cams about the pivot axis with indents in to which rollers or stops are spring biased can be embodied in the pivot assemblies to hold the ladder against its own weight in any designated position or provide controlled resistance or assistance to rotation.

Any type of retractable nested access structure can be fixed into the access aperture using the spring biased cantilever pivots and detachably attached mounting apparatus but the preferred ladder type is the telescopic or extending ladder where the stiles are of identical or similar profile, interlocked, offset and adjacent to one another and the ladder assembly arranged with width reducing from bottom sliding element to the top fixed element.

This arrangement is beneficial as it is a more stable ladder to use but significantly in the nested fully retracted configuration the closed assembly when viewed from the principal elevation creates two triangular voids within its rectilinear volume and profile of the closed ladder assembly. These voids can be of sufficient volume and useful geometry as to enable the ladder, cantilever supporting pivots and mounting apparatus to be located.

So this configuration is notable in that it is possible to arrange all the functional parts of the ladder assembly, the supporting spring biased cantilevered pivot mounting arrangement within the three rectilinear Cartesian coordinates of the ladder assembly making it notably compact and enabling it to be fitted to even smaller loft access apertures.

Other retractable multiple section ladders, such as tubular telescopic, concertina, overlapping sections, can be arranged to use this spring biased cantilevered supporting and operating mechanism.

A preferred ladder is one with offset stiles, duplex sliding bearings, automatically engaging spring biased locking means to lock each sliding section as the ladder is fully extended, and retaining means to secure all the sliding ladders sections together as one unitary retracted and restrained assembly. The ladder assembly can also be constructed with no intermediary bearings between sliding elements. In other forms the cantilever supporting pivoting means can extend beyond the Cartesian coordinate boundaries of the ladder.

The sliding ladder elements can be fitted with no intermediary bearing means the elements just sliding against each other with material to material contact. Plain sliding bearings of suitable material can arranged between the sliding sections. Duplex sliding bearings are preferred as they enable low friction sliding and the full transmission of torsional and bearing loads from sliding element to sliding element without damaging the sliding bearings.

The locks or latches can be so configured that the ladder can be arranged to extend or retract from the bottom element upwards or the top element down.

In one simple form the access structure is restrained in the nested format by means of a rigid or elastic strap and fasteners, the strap being continued to form and provide a means to pull the ladder down from the loft access aperture and then released to extend the ladder. In this format it is not essential to use locking or latching means to secure adjacent sliding elements of the ladder in the nested retracted configuration. The elasticity of the strap or the strap mounting enables the spring bias to retain the ladder assembly as a compact nested assembly.

As an alternative to a flexible or extendable strap, a rigid or semi rigid closure may be used to retain the sliding elements in the nested retracted ladder format and also provide a means to lower the ladder assembly from the loft access aperture. In a preferred embodiment, the retention means for the retracted access structure comprises: a non-extendable strap, a locking plate, a spring biased detachably attached locking means with one end of the strap fixed to the first or uppermost sliding element and the spring biased locking means on the outer most or bottom sliding element on the access structure. A locking plate is attached to the strap in a position that when the locking plate is inserted and retained in the spring biased locking means the retracted access structure is restrained from opening or extending. The strap continues beyond the locking plate and locking means to provide means to lower the retracted access structure against the spring bias of the supporting structure.

A notable safety feature of this retaining means is the need to simultaneously unlock two independent locking elements in a spring biased locking means to release the locking plate and strap so allowing extension of the access structure. The release points for the two locking elements are typically located at either side and base of the outer most or bottom sliding element such that the operator has to place one hand either side on the base of the access structure so supporting the weight and preventing accidental extension of the access structure while the retaining means is released. In one embodiment the spring biased locking means, locking plate and strap are located centrally on a cross member conjoining the sides or stiles on the outermost sliding element and the release elements extended either side or the locking means to the each side of the outermost sliding section where they can be released by each thumb on each hand displacing each of the two locking elements.

Extension of Ladder

The access device, in this description, a ladder and supporting assembly can be fitted in a loft access aperture whether there is an existing door or access panel or not. With the ladder assembly and supporting means cantilevered horizontally from one side of the access aperture and the door lowered or removed the ladder can by holding the extended part of the strap be pulled down against the spring bias of the pivotal supporting means during which motion the spring bias is arranged to go "overcentre", or from one indent to another, and the spring bias changes from spring biasing the assembly naturally up to now holding the ladder down in its working, usually a near vertical, position. The ladder retaining device is then unfastened allowing the nested ladder to be fully extended each section automatically locking in pre-set positions to form a secure fully locked ladder. The ladder is concurrently or subsequently lowered to the floor ready to use.

Feet are located on the base section of the ladder to eliminate movement and damage to the floor. Alternatively compliant rollers or roller could be used as an alternative to static feet.

Release and Stowage of Ladder

In one configuration of the cantilevered ladder assembly two safety catches located either side on the outside of each stile on the lowest sliding element must be displaced simultaneously to unlock the lowest ladder sliding element. Having depressed the two safety catches the lower sliding element is raised sliding eventually on to the next sliding element until the leading and upper edge of the stiles on the first moving element make contact with and depress cams on the stiles on the adjacent sliding element causing each to unlock whereupon the second sliding element can be freely raised and retracted along with the first sliding element. These then slide further on to the third sliding element causing this to automatically unlock, the process repeating until the user has unlocked, lifted and retracted all the sliding elements on to the cantilever supported fixed upper ladder element. The nested retracted ladder assembly is then restrained by fixing the locking plate attached to the strap into the spring biased locking means on the outermost sliding element.

In alternative configurations, each sliding element has a latch mechanism arranged such that when each element is fully retracted a latch or lock engages between each adjacent stiles. When then next sliding element is retracted the locks or latches engage in the adjacent sliding element so when fully retracted in the nested format the ladder is fully restrained by the interlocking locks or latches located between adjacent stiles.

The bottom sliding element is conjoined by a tube, plate or rigid member which maintains this sliding element as a geometrically correct, rigid, robust structure to resist lateral and rotational movement when the user opens and closes the ladder assembly. Feet or rollers can be attached to this member that can also be used to hold the nested ladder assembly and provide location for the detachably attached locking plate and locking means.

The ladder may incorporate a handrail on one or both sides of the ladder. It is a notable feature that the ladder is not supported or held in a frame or carriage. The entire ladder is held, cantilever supported from one end, in the horizontal stored and near vertical working positions from the uppermost ladder element which is fixed to the moving and rotating part of the spring biased pivots. The nested assembly can be stored or located in a vertical orientation or any angle between vertical and horizontal.

The static parts of the spring biased pivots are fixed by any suitable device or fastener to the mounting surface of the loft access aperture, the other pivoting end to the top element of the ladder. The spring bias can be configured in many ways around a pivot or pivoting linkage.

In this instance the pivot has a spring such that in the horizontal format the springs create a holding torque transmitted to the top element of the ladder so that the full weight of the ladder is held by the spring force. As the ladder is lowered and the hinge rotates the spring axis passes over the centre line between the two anchorage points for the spring and the spring force then assists in keeping the ladder down in its lowered working position.

Other forms of spring biased hinge, linkage or mechanism can be used to hold the ladder in its cantilevered and working positions. Common to all these mechanisms is the ability to hold the ladder in a horizontally cantilevered stored position above the loft access door and also in the near vertical position when the ladder is ready to use, or any other preferred positions. The geometry, nature and spring bias of the pivot or linkage can be arranged to provide a number of alternative functions.

To provide the holding force for the cantilevered access structure in the horizontal stored position in the loft access aperture to reduce the force required to lower and return the access structure from the horizontal stored position to the near vertical working position.

To bias against the gravitational force due to the mass of the access structure and mountings as it is lowered and raised.

To reverse the load on the access structure so that during the rotation of the pivot or opening of the linkage the forces are changed from biasing the access structure upwards to spring biasing the access structure downward.

To create fixed positions where the access structure can be located and parked. By changing the geometry of the linkage or cams and the spring bias on the rotating pivot vary loads holding or driving the cantilevered access structure.

The pivot, linkage or mechanisms can have features to create end stops for the ladder in the stored and working positions for the ladder assemble and at any points between. These may be preferably but not exclusively adjustable. These can be used to adjust the orientation or position of the access structure. The spring bias can be configured to be adjustable.

The non-rotating fixed parts of the cantilevered spring biased pivot, linkage or mechanism can be fixed directly to the mounting surface in the loft access aperture. However in a preferred configuration of the present disclosure it is advantageous to have a means of detachably attached means of fitting the access structure rapidly, easily, accurately, safely and with less effort into the loft access aperture.

A mounting plate with hooking or retaining means is so arranged that can be fixed independently to the nominally vertical surface of the loft access aperture. A template or measurements can be provided to give the correct location for the mounting plate. The mounting plate is light and can be quickly and easily fixed without the encumbrance of the bulk and weight of the entire ladder assembly a significant problem when fitting other loft ladders.

With the mounting plate and detachably attached mountings anchored to the loft access aperture the access structure and cantilever supporting spring biased pivot assemblies are lowered on to the mounting or retaining means such that holding members locate securely and the weight of the ladder hold the ladder in the correct mounting position. With safety retention devices removed the access structure and cantilever supporting spring biased pivot assemblies can be easily removed for replacement, maintenance or increased access through the access aperture.

There is provision for safety fastening or retaining pins such that with the access structure and cantilevered supporting assembly are attached to the mounting plates, safety fastenings are secured and the access device cannot be removed or displaced accidentally.

There can also be provision, in or between the cantilevered mounting assemblies and the mounting plate for adjusting the height and angular position of the ladder assembly.

Access apertures are often of unknown mechanical and structural integrity and another embodiment is the use of a pair of mounting plates not only providing the attachment means for the spring biased cantilevered ladder assembly but also providing means to improve the structural load bearing of the access aperture and to better distribute the cantilevered loading created by overhanging mass of the entire ladder assembly. There are many alternative configurations but the following embodiment demonstrates all the intrinsic features offered by installing a pair of mounting plates.

In this example of an alternative mounting apparatus using matched pairs of mounting plates the fixed element of both pivots are conjoined by a single bar or structural member creating a common and unitary hooking or attachment means to the two independent mounting plates. Each mounting plate has a receiving means for the unitary bar or structural member and one or both can have an additional means to safely secure the hooking means onto both attachment means, one on each mounting plate.

In this example each mounting has two adjacent flat surfaces perpendicular to each other acting as one unitary structural element. Within pre-set maximum and minimum dimensions the plates are fixed in to adjacent corners either end of the mounting surface of the access aperture and horizontally aligned. Each plate has a hook or attachment means to receive the single bar or structural member conjoining the two hinges on the cantilevered ladder hinge assembly.

The arrangement of the single bar or structural member and receiving means is such that the plates can be in contact with each other at centre of the mounting surface of the access aperture or any distance apart up to the dimensional limits of the single bar or structural member.

The pair of mounting plates, flat or right angled can be fixed in wide range of access aperture widths. Preferably the right angled plates nest into the corners at each end of the common mounting surface for the cantilevered ladder assembly. The two plane surfaces of each mounting plate have a plurality of holes to enable the mounting plate to be fixed both to the common surface and the adjacent surfaces or faces of the access aperture.

The mounting plates in this configuration provide improvements for retaining the ladder in the access aperture. Each right angle plate acts as robust structurally strengthening element at the two intersections of the access aperture. Secondly the turning moment imposed on the principal mounting surface of the access aperture by the cantilevered weight of the ladder and pivotal mounting assembly can be transferred partly or in whole to each adjacent side such that plate fixings take the forces of the turning moment on the fastening means in shear rather than axially on the common mounting surface. In shear the fastening is stronger and more reliable and more able to resist the turning moment than the axial loading of the fastenings in the common mounting surface. As such the integrity, reliability and safety for the ladder attachment is greatly improved.

The adjustment of the hooking means may also be achieved by having adjustable structural members extending and clamped on the outside of each pivotal assembly or hinge. There are many are such similar arrangements.

In other examples for mounting plates the plates may provide the means for other functions such as providing fixing, hinging and locking for a door.

There are many access devices such as ladders with telescopic or extending structures that collapse into a compact assembly for ease of storage and transportation. These telescopic ladders are used as an alternative to a fixed ladder, or a traditional two or three element extension ladder. The telescopic ladders or extending ladders typically have one or two rungs on each sliding elements each sliding on and locking to the adjacent sliding element to create a fully extended ladder.

Due to their compact form they are also used for loft or attic access and can be fitted adjacent to the loft access aperture, typically above or in proximity to the loft access door. Typically the door is manually opened and the ladder is manually pulled down and extended.

Loft ladders of all types, including telescopic, extending, folding and concertina, are fitted and while they give the user access to the loft or attic and access to useful space they are often difficult and potentially dangerous to install and use, especially for younger, older and less agile people.

So it is advantageous to be able to open and close the loft access door and loft access ladder remotely so the user can access the loft or attic safely and frequently with minimum physical effort and with no fear of being hit or injured by descending ladders or doors when pulling them down or replacing them manually.

There exist powered loft access ladders and stairs that can be fitted to access the loft and they are operated by motors with linkages or drives to lower the ladder and door automatically with a switch or remote control device used to open and shut the door and ladder.

These ladder assemblies are bulky and often too large to fit existing loft access openings or apertures requiring constructional modifications and redecoration to the ceiling and floors around the access aperture. The powered loft access devices already in use are also costly, heavy and bulky and they usually require two or more people to fit over an extended period of time so they are not widely adopted.

A lighter, more compact powered automatic access device remotely controlled is a useful alternative.

It is advantageous that a remote controlled powered automatic access device such as a loft ladder is very compact, has the smallest physical profile and volume in order to fit in most existing access apertures, is lighter, is easily installed, is safe and easy to use. By the combination of many novel, material, constructional, operational and functional features the invention described here provides an improved solution for an automated powered automatic access device for access from one place to another such as access to lofts and attics. It has other applications such as to form a tower, platform, surface, bridge, or leaning ladder.

This automated powered automatic access device is designed and engineered to work with all types of nested telescopic or extending ladders but the preferred configuration uses sliding ladder elements typically but not exclusively with one rung for each sliding element and stiles of like or similar profile offset from each other at a constant pitch and interlocked so that, each sliding element, and so the ladder becomes wider and more stable towards the bottom.

Other ladders, even the generic telescopic ladder with predominantly concentric round tubular stiles, can be incorporated in this same automated powered automatic access device. The common element to all ladders of this type is that they can be extended in a singular plane or axis one or more sliding elements at a time and any sequence.

For the automated powered automatic access device with an integrated door to work effectively the sliding elements making up the telescopic or nested access structure such as the ladder must be safely released from the locked or secured nested assembly attached adjacent to the loft door access aperture, extended and automatically locked in the extended position simultaneously unlocking or unlatching the next adjacent sliding element so that is extended and automatically locked, this sequence being continued until all elements are extended and locked.

The locking means securing adjacent sliding elements is typically but not exclusively a robust strong locking pin spring biased from one sliding element to engage in a hole or receiving features in the adjacent sliding elements. The sequential locking, latching or release means is preferably located on and interacts between adjacent stiles on a ladder assembly, alternatively this latching or release means can be located and operate between the ladder and frame to which it may be fixed.

In order to understand the detailed constructional and functional features of the invention it is beneficial to describe how this novel automated powered automatic access device functions.

The installed assembly consists of a supporting frame hinged pivotally at one end to a back plate that is fixed using a detachably attached adjustable mounting to one vertical side of the access aperture. In the preferred horizontal position, as fitted, in such as a loft access aperture the pivotal supporting frame is held in the closed position by extendible supports or links between the fixed part of the frame, the mounting frame, which is attached directly or with detachably attached mountings, to the aperture surface and at the other end to the outer part of the pivotal supporting frame with the nested access device in this instance a ladder assembly located on top of the frame and powered drive assembly. The mountings for the automated powered automatic access device can also be configured to increase the mechanical and geometrical integrity of the access aperture, improve the process of mounting and dismounting the automated access device, and make it easier to install and use.

When the power is applied, in one instance, by such as an electric motor, the automatic powered automatic access device is switched on, by a directly coupled switch or by a remote controlled transmitted signal operating a switch, a sliding mount at one end of the flexible support progresses along a slide embodied in the pivotal support frame and the door lowers toward the working angle of the ladder. Once or even while the ladder assembly opens below the ceiling level and is clear of the aperture the ladder continues to extended further one sliding element at a time by the powered drive assembly. At the desired or pre-set ladder angle the sliding mount at the one end of the flexible support reaches an adjustable stop but the drive is so arranged that the ladder continues to extend from the outer end of the pivoting support frame until all sliding elements are fully extended and locked and the drive automatically stops. The ladder is safely positioned and ready to use. The limit to the extendible link, or stop may be adjusted to change the ladder orientation.

When the powered automatic access device is switched on the next time the powered drive starts, in reverse direction, immediately retracting the sliding elements, in this instance ladder elements, with the ladder at its' working angle, retracting from the first sliding element of the ladder until all sliding elements are returned to the fully retracted position. As the first sliding element retracts cams on this sliding element release the locking pins on the next or adjacent sliding element allowing this to be retracted in sequence and as the second sliding element is about to be engaged and retracted a latch secures the first moving element in the fully retracted position. The next sliding element is then retracted and latched safely and the next sliding element released, this process repeating until all ladder sliding elements are retracted and latched securely as one unitary assembly on the top of the supporting frame. As each sliding element is fully retracted it is held by latches to the adjacent nested sliding element or the frame or structure supporting the ladder.

As the last sliding element retracts it enables the ladder, the access structure, supporting frame and door assembly to pivot and close, the ladder being fully retracted before ladder assembly ascends into the loft access aperture so avoiding collision with the ceiling or aperture boundaries. The mount on the flexible support in its reversed mode continues to return along the slide so pulling the frame assembly, ladder, and drive unit into the door aperture and the door shut, and if desired locked, with the ladder assembly fully retracted and parked.

One or more sliding elements can be added to the outer most sliding element of the access structure to allow the frame to descend clear of the access aperture and ceiling before the first ladder sliding element is extended so reducing the length of the required access aperture.

The extendable flexible supports or links are strong and secure enough to hold the ladder, frame and door tightly in the closed position but if preferred the door can be locked or latched independently of this support or link. In this configuration, the powered drive is able to engage and disengage a latch or lock, at the end of the closing sequence or start of the opening sequence respectively.

As the invention embodies many novel features of individual and collective note a more detailed description of the device, its component parts and its functionality continues.

The access device or ladder is preferably fully automated having one or more powered drive means which can be controlled by a signal from a mechanical switch or remote control transmitter device and receiver located on the installed ladder and frame assembly. In the preferred configuration of this device there is only one powered drive means, a tubular electric motor with integrated gearbox and controls and this directly or indirectly initiates and or performs all the functions required to release and lower the door and ladder into their working positions and to return the same to the their fully retracted and closed position. It can also be configured to open and close a door catch or lock at the beginning and end of the sequence.

The preferred drive is a tubular motor with an integral gearbox and controller and switched on by a transmitted signal to a remote control switching and control unit. The tubular motor is fixed within a concentric drive tube, typically of a castellated tubular element driven from one end by the motor and supported the other end by a bearing and journal. In this instance the castellation serves to align the gears and transmit power to the gears and one example of the drive the concentric tube has a plurality of spur gears along its length with each spur gear aligned in the castellated drive tune section with a linear gear rack that is fixed to each slide or stile on all driven sliding elements. Each sliding element of the ladder is extended and retracted by a dedicated spur gear and corresponding gear rack attached to or an integral part of each slide or stile either side of the rung. The pitch or spacing of the spur gears on the drive tube is matched to that of the corresponding gear racks and slides on the access device or ladder. There are two groups of spur gears, a gear cluster, on the drive tube that correspond to the two groups of slides or stiles and gear racks either side of the rungs or stepping means.

One spur gear set or cluster is sufficient to drive extend and retract the access device or ladder but two, one placed either side of the ladder maintain alignment of the ladder and place the driving means more evenly.

The tubular motor with the enclosing concentric drive tube and spur gear clusters is connected at one end to a side member of the frame and the other end freely supported. The compact nested retracted ladder assembly is attached through mountings on the uppermost element of the ladder to the supporting frame in such a position that the gear racks underneath the ladder stiles locate on and engage their respective spur gears on the drive tube. The ladder attachment means can be spring biased so as to keep the spur gears and racks in mesh. Alternatively the gear mesh between spur gears and gear racks can be mechanically retained. Safety covers can be fitted around the spur gears. The gear racks for the ladder assembly are located and fixed to the stile or slides and riveted or screwed into position to create a direct mechanical link between the two. The gear racks are preferably constructed of plastic, but not limited to such, in order to reduce noise and wear and the gear teeth are supported on both sides as well as at the gear root to act as a guide for the spur gear and to significantly increase the strength of each gear tooth. The side edges of the racks also provide a supporting edge that run on a diameter of the drive tube either side of each spur gear so maintaining accurate gear engagement and reducing loads on the gear teeth. The gears or teeth for the gear racks may be cut into the extruded profile of the slide or stile elements.

A control member may be added to the sliding elements such that a fixed pad or roller bearing can be added to ensure the correct and continuous mechanical engagement between the driving and driven gears. The pad or roller may be detachable to allow easier mounting of the ladder assembly onto the frame.

The gear racks are so arranged that each pair of gear racks on the first sliding element synchronise with the gear racks on the next or adjacent sliding element so when two adjacent sliding elements are locked together the gear rack from one meshes with the next so creating a continuous effective gear rack of consistent gear pitch for the length of the extended ladder. In the nested format of the ladder and at the point when the motor starts extending the ladder only the two gear racks on the first sliding element are in contact and mesh with the mating spur gears on the motor drive tube and as the sliding element is extended forward it pulls the gear racks on the adjacent sliding element to mesh with the next pair of spur gears and this continues until all sliding elements of the ladder are fully extended. The last element to be extended can be similarly secured by a locking pin or retained in position by the holding torque of the motor and gearbox.

In the fully extended ladder configuration and with all sliding elements locked relative to the adjacent sliding elements the gear racks are so arranged that the gear rack in one sliding element is adjacent to and overlaps the next gear rack by one or more gear teeth or pitches. The arrangement of gear racks as such forms one continuous gear rack along both sides of all the sliding ladder elements. As the spur gears are arranged in two clusters with the gear teeth aligned to each other the spur gear sets synchronise each pair of gear racks on any one sliding element. Each spur gear set may be assembled as individual spur gears held together as a cluster or each set machined as a single homogeneous part from an extruded profile.

When the ladder or access device is to be closed and sliding elements retracted the motor is switched on starting in the reverse rotation. At this point the gear racks on the first sliding element of the ladder are sitting on the innermost pair of spur gears on the power drive assembly and immediately retract, on to the uppermost element, which is fixed to the supporting frame and having no need for gear rack or drive.

At this point in the retraction cycle the powered drive, through the spur gears and gear racks is lifting all ladder sliding elements except for the uppermost fixed element held by the latches, or permanently secured. Preferably but not essentially the ladder stays at its working inclination while all the ladder elements are retracted toward the fully nested most compact, shortest, format.

As the first sliding element reaches the end of its linear displacement, the gear racks either side of the next sliding element engage with the next set of spur gears and simultaneously cams extending below this and the next sliding element release the adjacent locking pins so the preceding element is no longer engaged to the powered drive and can park in a stationary position and then the next sliding element retracted. To achieve this transfer the adjacent pairs of overlapping gear racks have to be locked together and in meshed or synchronised and engaged to their respective spur gears such that the preceding pair of racks is pushed off, and disengaged from the spur gears and powered drive. Once the first gear racks are disengaged the respective locking pins can be withdrawn, the first sliding element latched or locked in the parked position and the next sliding element retracted. Thereafter at each transition between sliding elements the same process of the gear rack being disengaged from the driving spur gear, the locking pin retracted and unlocked, and the stationary element being latched or locked in the parked position continues for all sliding elements until the lowest and last element is retracted.

When the last, the bottom or outer most sliding element, whether the sliding stile element or slave sliding element, is retracted this last sliding element stops and is locked in its parked and nested position by stopping the powered drive, an additional lock can be retained to lock the door but in some applications it is unnecessary, such as when the motor and gearbox provides a holding force. Preferably the tubular motor and gearbox assembly has limit switches one for completing the forward cycle extending the ladder and the other for the reversed cycle retracting the ladder. These switches are adjustable but for a fixed length of ladder this adjustment can be pre-set to match the length of the ladder.

The retention of the nested ladder, and the individual sliding elements is part of the automated extending and retracting cycle. When the loft access door, attached to the underside of the pivotal part of the frame lowers along with the ladder assembly the nested ladder is near vertical and the latches ensure the ladder elements do not individually or collectively open under their own weight.

The latching or locking means for the nested ladder is preferably sequenced or synchronised with the opening and locking, the unlocking and closing of the sliding elements. It is preferable that the latches or locks are arranged between adjacent sliding elements but alternatively they can be located to act between the sliding elements and the supporting frame to which the ladder is fixed.

A typical drive for the extension and retraction of the ladder is now described. The automatic access device will work in any orientation of the ladder assembly or access structure.

Starting with the ladder nested or fully retracted the first sliding element is extended and toward the end of its movement stops on the first sliding element engage with the stops on the adjacent sliding element so pulling the next sliding element on to the driving spur gears, and simultaneously the retaining latches are released, the locking pins align, lock and the sliding elements are locked together. This operation repeats until all elements are extended and locked. For the return and retracting cycle the uppermost free and sliding element is retracted and as it nears the end of its travel cams unlock the sliding element from the adjacent sliding element, and so disengages from the spur gear and is latched in the retracted or nested position.

In this example of the invention all locks and latches are integral with the access structure or ladder assembly which can be detached from the supporting pivotal frame in this working configuration as one unitary assembly and could be used as freely portable free standing ladder. In other forms of the invention the retaining latches can be connected to the frame supporting the access structure and latch on to individual sliding elements or attached to the sliding elements and latch onto the frame.

The extension and retraction of the ladder has been described but another feature of this invention is that the drive for the ladder transformation can also be used to raise and lower the ladder and door to and from the operating and stored positions and also lock the door and ladder in the stored or closed position. The moving parts of the ladder, the sliding elements, can provide the opening and closing force to raise and lower the automatic access device and close and locking means for the access door or panel.

Additional drives and mechanism can be used for this purpose but are generally complex and unnecessary.

There are alternatives as to how the one motor drive and the resultant movement of the ladder can be used to raise and lower the ladder and provide locking means but the preferred configuration utilises the same linear movement of the ladder's sliding elements or simulations or extensions of these coupled and connected linear movements.

One exploitation of this drive is to use the linear displacement of the first and outermost sliding element to drive a linkage or mechanism to close and open the door and access device and lock and unlock the door. Indeed the displacement of this and other sliding elements could perform other useful functions such as but not limited to, locking the door, switch on a light, securing a handrail, and initiating and alarm.

In this instance of the invention either side of the supporting frame there is a wire, cord or chain anchored to a fixed plate at a distance above the frame hinge pivot centre which is attached to a secure structural member on the loft access aperture. These flexible cables, cords or chains extend to and run around freely rotating pulleys or sprockets located toward the outer end of the pivotal supporting frame. The cables, cords or chains then extend further back toward the ends of the flexible supports which are fixed to sliding blocks or mounts located on slides or in slots forming slides that extend along the side support plates of the pivotal supporting frame. The slots forming the slides are preferably parallel and aligned with the linear movement of the ladder with the fully retracted nested ladder fitted to the pivotal supporting frame and mounting frame, the automated access device and door typically lie horizontal in the loft access aperture, and the door fixed to underneath the pivotal support frame, the weight of the ladder, door, supporting frame and powered drive is held by the two flexible cables, cords, or chains the tensile force in the being transferred around the pulley or sprocket to the sliding block or mount which is restrained from moving by the top of the stiles or slides on the bottom sliding elements of the nested ladder.

The frame can have an adjustment means to accept a range of door and door and insulation thicknesses when the motor drive operates the first sliding element of the ladder or access device starts to extend away from the nested retracted ladder assembly the sliding blocks in the slides following as the tensioned cable, cord or chain maintains load and contact on the sliding blocks holding the sliding block on the top or the stile or slide. As the sliding block is pulled away from the hinge pivot the effective cable, cord or chain length, the distance from pulley to wire anchor increases so lowering the end of the hinged pivotal support frame continuing as the sliding element extends further until the sliding block is restrained against a stop, which is preferably adjustable, at the other end of the slide and the ladder and door are set at an angular inclination where it can be used. Following this transition the sliding elements continue to be extended having no other effect on the door and frame opening and lowering. The ladder extension then continues until all sliding elements are fully extended in this position.

In the reverse cycle when the ladder is retracted the ladder initially remains at the same working inclination. When the last and bottom sliding element is retracting the top of the stiles either side of this sliding element make contact with the sliding block or mount, to which the supporting cables, cords or chains are fixed, and the powered drive transfers additional load, transmitted from the motor and gearbox through the drive tube, spur gears, gear racks and slides to move the sliding block and supporting means back along the slot so effectively shortening the length of the flexible support, and therefore the distance between the pulleys and the respective anchor points, causing the ladder assembly, supporting frame and door to close up to a parking position in the access aperture.

With the motor switched off the ladder and door are held in position by the holding torque of the drive assembly. An independent lock or latch can be used as an alternative and can be locked and unlocked as part of this sequence.

The same linear motion of the sliding elements or the rotational movement of the motor drive can also be used sequentially or simultaneously to lock and unlock a door catch or lock or operate another device.

Using the same motor drive and the linear transformation of the ladder, for extending the ladder and all other functions, reduces the complexity and cost for this device. It is however a notable benefit of this invention that the access device is of the minimum possible by length, breadth, height and volume, so enabling fitting to all from small to large loft door apertures without modification so extending the applications as to where it can be fitted.

While the use of the linear movement of the sliding elements is an efficient method to raise and lower the door and ladder assembly it requires the first sliding element of the nested ladder to extend before the ladder exits the loft access aperture so allowing the ladder to be fully extended. This necessitates the access aperture being substantially longer than the ladder and frame assembly and requires a larger loft access opening.

To reduce the size of the loft access aperture to the smallest possible for this device, in one form of this invention there is an additional sliding mechanism, using a similar rack and pinion drive to that on each sliding element that lowers the door and the nested ladder assembly first, before any of the sliding ladder elements on the ladder start extending so that the ladder lowers and clears the edge of the access aperture or ceiling before the powered drive starts extending the ladder. In this instance, the same spur and gear rack arrangement is used with identical gear size and pitch. An additional gear rack conjoined to a slide and a push rod making contact with the sliding block is placed along either side of the first sliding elements and ensures the end of the gear rack and the mechanism does not extend beyond the bottom and leading edge of the nested ladder assembly and access device in its entirety while the door and ladder assembly is lowered below the edge of the aperture or ceiling.

Once the ladder is clear of the aperture or ceiling edge, the end of this additional sliding part pushes the adjacent sliding element, the first sliding element of the ladder, so meshing the spur gear and gear rack and initiating the full ladder extension in the same manner as previously described. So in the first instance with this arrangement the sliding block connected to the wire, cord or chain is in contact with end of the push rod not the end of the ladder stile.

For the closing of the automatic access after all the sliding elements are fully retracted the gear rack on the additional sliding part is already synchronised and positioned aside the adjacent gear rack on the lowest and last sliding ladder element to be retracted, the additional gear rack and push rod pushes the sliding block and pulls in the flexible supports and so closes the ladder and door. This auxiliary sliding element can also be used to lock and release a door catch or lock.

One configuration of the independent door opening feature has been described but there many other door opening and closing mechanisms that can use the linear movement of the ladder or the rotation movement of the motor drive to open and lower the door and ladder and lock and unlock the door.

In some forms of this invention, the flexible supports, such as cables, cord, wires or chains, are fixed at one end to the mounting frame, the fixed part of the pivotal frame assembly and attached to the mounting assembly retained to the access aperture. In the preferred configuration of this invention there are extended wire anchor plates, fixed to the mounting frame so as to increase the perpendicular distance to the pivotal frame fulcrum, in this instance the hinge pivot centre, and so reduce the forces in the flexible supports, and so reducing the torque to be provided by the powered drive. These extended mountings may be detachable to assist in the construction, transportation and installation of the device. The flexible supports may include an adjustable anchor means to adjust the operating length of the flexible support, located preferably at the fixed end of the flexible supports. Adjustment of the wire length enables the pivotal frame assembly and ladder to be aligned into the correct operating position or inclination.

The sliding block, slide, pulleys, flexible support and anchor points enable the ladder linear motion to lower and extend and retract and raise the ladder, and raise and lower the combined door and ladder assembly.

Preferably the flexible supports are wire ropes, but a chain, cord, cable or belt are some of the alternative support means, and in one instance each is retained at one end to the anchor plate on the mounting frame that is fixed to one side of the loft access aperture the other end is fixed to the sliding block. The sliding block slides along a slot preferably at an axis parallel to the linear progression of the ladder sliding elements ensuring the sliding block and the end of the stile remain in direct contact and encouraging the sliding block to run along the slot or slide with the minimum of perpendicular or offset loads that would cause wear between the sliding block and the guide, which in this instance is a slot in the side plates of the supporting frame. In other configurations of the flexible supports it may be advantageous to include an extendable spring between the end of the wire and the wire anchor plate. The inclusion of this spring enables the powered drive to continue momentarily once the ladder is fully closed and the assembly and door retained in the closed position in the loft access aperture with a predetermined tension in the flexible supports. As the spring is maintained under tension if there is any short or long term relaxation of the tension support the door remains closed under a spring bias and the access device remains in position.

There is an additional feature that can be added to the slot or slide to limit the travel of the sliding block that enables the adjustment of the ladder angle and as such to match the height of the ceiling to which it is fitted for any fixed length of ladder. The actual linear length of the extended ladder is defined by the distance between the rungs and the number of individual sliding elements in the ladder assembly. In this example of the ladder there are nine elements and the supporting frame and motor drive has provision for more or less without modification to the size of the frame.

An automatic access device can have any number of sliding elements of any size. So for any user the ladder can be supplied at a predetermined fixed length and it should be noted that this length and the spacing of the rungs has to comply with statutory regulations. These same regulations usually permit a ladder to be used at inclinations from 60 to 75 degrees from horizontal. This enables one fixed length of ladder to be fitted to a range of ceiling heights by adjusting the angle within these limits. This feature enables the user or installer to adjust the angle of the ladder assembly.

In this configuration of the invention the lowering of the access device, supporting frame and door and as such its angle of inclination is controlled by the position of the sliding blocks in the slots on the two supporting frame side arms. When the sliding block reaches the end of the slot the angle of inclination is fixed. By adding an adjustable stop before the end of the slot the final position of the sliding block can be adjusted to position the frame at any angle, in this instance between 60 and 75 degrees, to match any height of ceiling in a predetermined range for any fixed extended ladder length. This feature not only allows one ladder assembly to be installed to service a range of ceiling heights but it also provides the installer with a simple means to adjust the height and inclination of the ladder accurately to any ceiling height within the legitimate range. To do this the ladder frame is set up with the sliding block adjuster set just ahead of the first ladder angle setting of 60 degrees, say 58 degrees. After the ladder and frame assembly has been fitted to the loft access aperture and the electric motor drive connected to a power source the ladder is lowered and fully extended and the motor automatically switches off. In this configuration the sliding block is tensioned against the adjustable stop.

The ladder or access structure if correctly installed will on the first opening stop at the smallest pre-set angle and the base end of the ladder will not be making contact with the floor. The installer then adjusts the position of the adjustable stop, preferably in the form of an anti-back winding screw adjustment, so increasing the angle of opening until the base the ladder touches the floor. The adjustment for the sliding block is secured in this position and should not need to be adjusted again unless the automatic loading access device in fitted in a new location.

This adjustment and also the user's weight on the ladder can cause the base of the ladder stiles to make contact with the floor then move horizontally in relation to the surface or the floor, typically but not exclusively due to the ladder being nominally straight but actually taking some concave curvature due to the weight of the ladder and of the user and anything they may be carrying. This foreshortens the length of the ladder and so slightly changes the angle of inclination.

This horizontal movement can cause movement and rubbing at the base of the ladder and can cause damage to any floor surface or carpet the ladder base may bear on and equally the surface may be a long fibre soft material and prevent the ladder moving. So another feature of this invention is the location of a roller or a series of rollers supported across the stiles at the base of the ladder so preventing the ladder stile ends making contact with the floor surface. As the ladder is securely fixed at the top end then the fixing a roller at its' base is not detrimental to the safety of the ladder or its use.

The roller provides another useful function such that in other forms this invention the ladder or access device can be lowered and extended to floor and the roller makes contact with the floor before the ladder is fully extended the ladder length can increase as the roller proceeds along the floor so enabling the ladder to continue to extend to its full length with the angle of inclination changing at the same time.

One embodiment of the ladder extending and retracting means has been described, the rack and pinion, using driving spur gears and driven racks attached to the sliding elements. Any type of nested extendable ladder, or access structure, with interlocked or located sliding elements can be configured as the automatic access device and remotely extended by this and alternative drive means.

All multiple sliding element extendable ladders have predetermined dimensions to comply with government health and safety regulations the ladder rungs, steps or horizontal joining members, are typically spaced at fixed intervals along the ladder length and preferably at smaller fixed intervals in the full retracted nested configuration.

The regularly spaced and fixed locations of the rungs, stair treads or members in the extended or retracted configurations enable alternative drive means to be used to extend and retract the ladder, and directly or indirectly lower and raise the automatic access device, and unlock and lock the door or access panel. The geometric uniformity and consistency of the rung arrangement for any ladder of this construction or similar enables a simple oscillating, push pull, cycle that can be used to extend and retract the ladder elements. The oscillations can be linear in forward and reverse directions, as created by such as a pneumatic cylinder or a linear part of a continuously repeating reversing cycle such as a tensioned rotating chain around fixed sprockets at a set distance apart.

So in other embodiments of this invention the continuous powered drive provided by the previously described rack and pinion drive can be replaced by an intermitted linear drive indexing incrementally after each linear displacement of a sliding element.

This linear drive can be connected to the slide, stile, rung, cross member or any part of a sliding element to extend and lock the element release and return and at the end of each cycle the drive mechanism indexes by the offset of the next retracted or extended sliding element. The mechanism then connects automatically with this next sliding element and the extending cycles continue until the entire ladder is extended. The ladder is retracted by reversing these combined cycles indexed forward to match every rung on each cycle.

Each time the oscillating or cyclic connection is made the driving element can automatically lock or latch or align with each rung, then extend or retract the rung before releasing and returning to engage with the next rung or member.

The drive means for this linear indexing means can be but is not limited to, a linear actuator, a pneumatic or hydraulic piston and cylinder, a rotating motor driven chain configured as an oval path, a motor driven crank and slide, a linear motor.

The linking of the push pulling, cyclic means from the motor drive to the rungs can be but is not limited to an automatically mechanically indexed latch, an electrically driven latch, a solenoid or motor driven latch, or a raised pad or slot. The ladder is preferably extended from the bottom rung or sliding element upward or top sliding element downwards each type of drive and ladder requiring the more appropriate solution.

In this invention the detachably attached hinged pivotal supporting frame assists the safe and successful installation, operation and use of the device. In this instance the extendable ladder assembly is fitted to the supporting frame in the nested format. The ladder is attached to the pivotal part of the supporting frame using a fixed or freely rotating joint at the top and at both sides of the top element of the ladder. The nested ladder assembly can be retained on the spur gear sets in a fixed position by its' own applied weight, spring biased or mechanical retention on to the gears using suitable means.

In one example the pivotal part of the frame consists of a hinge element, two side members or plates, a middle tie and a front tie. The motor drive assembly extends across the frame between the two side plates near to the leading edge of the frame. The motor drive is fixed to one side frame to locate the restrain the powered drive or motor and the other end is supported in a bearing journal to allow rotation of the drive tube and spur gears driven by the motor. A tie is located across the middle of the frame to provide additional fixing or spring biasing for the ladder assembly and to provide additional fixing means for the door.

The detachably attached means to fix the access device and frames to the access aperture comprises two structural members fixed at either side of the static part of the hinge connecting the pivotal supporting frame and the mounting frame. The structural members attached to the mounting frame provide elevated anchorage points for the fixed ends of the supporting wires, cables or cords. These structural members can take any form so providing additional facilities for enclosing lighting and controlling means and adding handles or hand rails. In this instance there is a horizontal structural member conjoining the two vertical structural members so forming a stronger structure and providing adjustment means for attaching the automated access device to the access aperture.

The access device, frames and mounts can be attached directly to one side of the access aperture with suitable fixings. In a preferred embodiment of this invention there is provision for a rapid attachment, detachably attached mountings, or quick release feature that makes installation easier and also assists in improving the mechanical integrity and strength of the access aperture and mountings for the access device. There are many ways this arrangement can be configured but one account follows.

A pair of mounting plates each with two surfaces at right angles to each other and a plurality of holes, are provided and are fixed using suitable fasteners in the corners at opposite ends of the surface of the access aperture to which the powered automatic access device is to be attached. The two plates are constructed as mirror imaged pairs such that on the common surface they both have hooking and retaining means to receive and retain the horizontal structural member on the fixed part or the access device mounting frame. The hooks can locate anywhere along the axial length of the horizontal member so defining a range or widths the two mounting plates are apart and so enabling the automatic access device to be fitted to access apertures of different widths while still providing the same functionality and improved mechanical integrity.

The mounting plates, the hooks and retaining means can take many forms but the hook and clamp arrangement make installation, attachment and detachment of the automatic access device easier, safer and less physically demanding.

The installation is preferably achieved in sequential stages. First the mounting plates are horizontally aligned and fixed at either end of the surface into the corners of the access aperture. After this the pivotal frame assembly is located on to the hooks and clamped to retain the pivotal frame assembly. The door is then be fitted to the underside of the frame within the access aperture. Finally the extendable ladder assembly or access structure can be attached to the pivotal supporting frame and the gear rack retaining rollers fixed to fully engage and retain the powered rack and pinion drive.

In other instances the pivotal frame assembly and access structure can be hooked as one unitary assembly to the two mounting plates and the door then fixed to the underside of the frame.

While this automated ladder access device has been invented to be the smallest possible in order that it will fit into a greater number of existing loft access apertures it can be fitted into larger apertures. In these instances the only difference being the door is larger, and the detachably attached hooking members adjusted to a greater width but the door of appropriate size can still be fitted to the same frame interface without modification.

In other forms of the invention the automated access device may be configured to form a planar or three dimensional structure with one or a plurality of extending elements and one or more driving means to form a free standing ladder or structure, a tower, surface, platform but not limited to such.

The invention claimed is:

1. An extendable access device for gaining access to elevated locations via a hatch opening, comprising:

a telescopic ladder with a plurality of sliding elements movable between an extended position and a retracted position, each sliding element comprising two stiles connected by a rung;

wherein the stiles of each sliding element are interlocked with the stiles of adjacent sliding elements;

wherein each sliding element comprises a first locking mechanism for releasably connecting at least one of the stiles to an adjacent stile of an adjacent sliding element, the first locking mechanism being adapted to lock each sliding element in its retracted position;

wherein the first locking mechanism of each sliding element is adapted to releasably connect at least one stile of each sliding element to a stile of an adjacent sliding element, which is closer to a top end of the telescopic ladder, and is adapted to automatically disconnect said stiles once an adjacent sliding element, which is closer to a bottom end of the telescopic ladder, is in its extended position;

wherein the first locking mechanism is adapted to automatically connect the at least one stile of said sliding element to a stile of the adjacent sliding element, which is closer to the top end of the telescopic ladder, when the adjacent sliding element, which is closer to the bottom end of the telescopic ladder, is moved from its extended position towards its retracted position;

wherein the access device comprises an automatic actuator adapted to sequentially, continuously, extend or retract the plurality of sliding elements of the telescopic ladder;

wherein the sliding elements of the telescopic ladder are constructed such that each sliding element feeds an adjacent sliding element to the automatic actuator, when said B sliding element is moved into its extended or retracted position;

wherein each sliding element comprises at least one gear rack attached to at least one of the stiles; and wherein the actuator comprises a drive tube comprising a plurality of spur gears, each of which is aligned with a corresponding gear rack of a sliding element and adapted to engage a respective gear rack.

2. The extendable access device of claim 1, wherein the gear racks are constructed such that gear racks of adjacent sliding elements overlap in a longitudinal direction by at least one gear tooth, when at least one of the adjacent sliding elements is in its extended position.

* * * * *